US012203233B2

(12) United States Patent
Immel

(10) Patent No.: US 12,203,233 B2
(45) Date of Patent: Jan. 21, 2025

(54) SEISMIC REMEDIATION DEVICES, SYSTEMS, AND METHODS

(71) Applicant: Frank Immel, Seattle, WA (US)

(72) Inventor: Frank Immel, Seattle, WA (US)

( * ) Notice: Subject to any disclaimer, the term of this patent is extended or adjusted under 35 U.S.C. 154(b) by 106 days.

(21) Appl. No.: 17/952,970

(22) Filed: Sep. 26, 2022

(65) Prior Publication Data

US 2023/0103800 A1 Apr. 6, 2023

Related U.S. Application Data

(60) Provisional application No. 63/248,947, filed on Sep. 27, 2021.

(51) Int. Cl.
*E02D 5/54* (2006.01)

(52) U.S. Cl.
CPC ..... *E02D 5/54* (2013.01); *E02D 2600/40* (2013.01)

(58) Field of Classification Search
CPC .... E02D 5/54; E02D 5/60; E02D 5/64; E02D 2600/40; E01D 22/00; E02B 17/0034
USPC ..... 52/835
See application file for complete search history.

(56) References Cited

U.S. PATENT DOCUMENTS

2003/0163960 A1* 9/2003 Hadden ..... E04C 3/30 52/514
2003/0205008 A1 11/2003 Sridhara
2012/0145655 A1 6/2012 McMillan, III et al.
2018/0305929 A1* 10/2018 Sun ..... E01D 19/02

FOREIGN PATENT DOCUMENTS

CN 208717726 U 4/2019
KR 20050041555 A * 5/2005
WO WO-2011011834 A1 * 2/2011 ..... A01G 17/14

* cited by examiner

*Primary Examiner* — Kyle Armstrong
(74) *Attorney, Agent, or Firm* — Seed IP Law Group LLP

(57) ABSTRACT

A seismic remediation device includes a body with a first half and a second half structured to be coupled to the first half around an interface between a pile and a pile cap in a pile-supported structure. Each half of the bracket includes a base with a hollow half cylinder shape and an upwardly facing U-shaped flange coupled to the base. The bases of the halves of the bracket are securable around at least a portion of circumference of a pile and the upwardly facing U-shaped flanges of the halves of the bracket cooperate to receive a longitudinal portion of the pile cap. The halves of the bracket being coupleable to each other proximate the interface between the pile and the pile cap.

20 Claims, 13 Drawing Sheets

SEISMIC REMEDIATION DEVICES, SYSTEMS, AND METHODS

BACKGROUND

Technical Field

The present disclosure is directed to seismic remediation devices, systems, and methods, and more particularly, to a bracket for seismic remediation.

Description of the Related Art

Existing pile supported structures, such as docks, piers, and wharfs typically consist of vertical or batter-angled pilings that support pile caps or beams that span the pilings in rows. In a typical construction using wood pilings, the timber pile caps or beams are secured to the piling with a drift pin. Stringers are then run on top of the pile caps and the deck is installed on top of the stringers. In some examples where the piles are concrete, the piles are driven and concrete is chipped away at the top of the pile to expose some portion of the rebar of the concrete. The pile cap is then poured around the concrete piling with the piling and the exposed rebar embedded into the pile cap. The deck structure is formed and poured over the pile cap. A steel pile structure may be built similarly to a concrete pile structure with the piling filled with a rebar cage and concrete with a portion of the rebar exposed at the top of the pile and cast into the pile cap.

In a seismic event, the seismic waves travel through the ground and will move the pilings up and down. With a typical wood pile supported structure, the pilings can separate from the pile cap during the up and down movement from the seismic waves. The concern is whether the pilings will land back squarely, if at all, under the pile cap. With each seismic wave that passes through the structure and the piling, the likelihood of the piling landing under the pile cap decreases. If not, the structure can collapse and pose a safety risk to those on the structure or in the vicinity of the structure. Alternatively, if some of the pilings remain connected while others separate from the pile cap, the structure will lose the ability to support the intended load which can result in at least a partial failure of the structure. In some cases the structure can also fail or collapse where the load on the structure, such as the dead load, exceeds the maximum supportable load by the remaining connected pilings after a seismic event.

During a seismic event with a concrete piling structure or a steel piling structure, the movement is concentrated at the connection between the pile and the pile cap. The rebar or the steel in the concrete allows the concrete to resist a certain amount of tensile force due to the elastic properties of the metal. However, it is well known that the concrete material itself is very weak under tensile force. In other words, it is well known that concrete will fail when placed under tension. During a seismic event, the repeated up and down motion from the seismic waves produces repeated cycles of tensile and compressive forces at the connection between the pile and the pile cap that are likely to cause the concrete to crack and fall away, leaving nothing but the rebar or steel to support the structure. In some cases, the rebar or steel may prevent a total collapse, but the structure will not be able to handle the intended load. In some severe cases, the seismic event is strong enough or the rebar or steel is too weak to support the remaining load and the structure will collapse. In either situation, the failure of the concrete due to a seismic event poses a safety concern to those near the structure as well as loss of use of the structure itself if it cannot support the intended load after a seismic event.

Moreover, it is difficult and expensive to address the above concerns with known pile supported structures. For example, installation of known seismic upgrades may require closing access to the structure, disassembling all or part of the structure, installing the upgrades, and reassembling the structure. This process has high labor and material costs while also restricting access to the structure for an extended period of time, which can cause a loss of revenue for the owner of the structure or negative impacts on local infrastructure in some examples.

Thus, known pile supported structures have several disadvantages during seismic events that can pose serious safety concerns as well as loss of use of the structure itself after a seismic event. Known seismic upgrades are prohibitively expensive and time consuming to install, which limits their applicability. It would therefore be desirable to have a system that overcomes the shortcomings of conventional seismic remediation devices.

BRIEF SUMMARY

In one or more embodiments, a bracket may be summarized as including: a body including a first half and a second half structured to be coupled to the first half, the first half of the body including a tubular base having a hollow half cylinder shape, a lower channel defined by the tubular base, an upwardly facing U-shaped flange coupled to the tubular base, and an upper channel defined by the flange; the second half of the body including a tubular base having a hollow half cylinder shape, a lower channel defined by the tubular base, an upwardly facing U-shaped flange coupled to the tubular base, and an upper channel defined by the flange, wherein the lower channel of the first half of the body and the lower channel of the second half of the body are securable around a circumference of a pile and the upper channel of the first half of the body and the upper channel of the second half of the body are securable around a longitudinal section of a pile cap.

The bracket may further include: the lower channel of the first half of the body being perpendicular to the upper channel of the first half of the body; the lower channel of the first half of the body having a same size and shape as the lower channel of the second half of the body; the upper channel of the first half of the body having a same size and shape as the upper channel of the second half of the body; the upwardly facing U-shaped flange of the first half of the body including sidewalls that define the upper channel of the first half of the body, the sidewalls of the upwardly facing U-shaped flange of the first half of the body being flat and planar; and the upwardly facing U-shaped flange of the second half of the body including sidewalls that define the upper channel of the second half of the body, the sidewalls of the flange of the second half of the body being flat and planar.

The bracket may further include: the first half of the body including tabs and the second half of the body includes tabs corresponding to the tabs of the first half of the body, the first half of the body being coupleable to the second half of the body with nut and bolt assemblies through the tabs of the first half of the body and the tabs of the second half of the body; the first half of the body being coupled to the second half of the body with at least one of a welded connection, a bracket, and a latch; and the tubular base of the first half of the body and the tubular base of the second half of the body each including a first material having a modulus of elasticity and a second material having a modulus of elasticity greater than the modulus of elasticity of the first material, the second material positioned proximate an interface between the pile and the pile cap to reduce strain at the interface.

In one or more embodiments, a device may be summarized as including: a bracket structured to be coupled to a pile and a pile cap of a structure, the bracket including a first half including a lower channel and an upper channel and a second half including a lower channel and an upper channel, the second half structured to be coupled to the first half with the lower channel of the first half and the lower channel of the second half cooperating to define a pile channel securable around at least a portion of a circumference of the pile of the structure and the upper channel of the first half and the upper channel of the second half cooperating to define a pile cap channel securable around at least a longitudinal portion of a pile cap of the structure.

The device may further include: the lower channel of the first half and the lower channel of the second half each having a different shape than the upper channel of the first half and the second upper of the second half; the lower channel of the first half being perpendicular to the upper channel of the second half; the first half of the bracket including a base and an upwardly facing U-shaped flange coupled to the base, the lower channel of the first half of the bracket defined by the base and the upper channel of the first half of the bracket defined by the upwardly facing U-shaped flange, the base of the first half of the bracket having a hollow half cylinder shape and the upwardly facing U-shaped flange of the first half of the bracket having a rectangular shape with flat and planar sidewalls; the second half of the bracket including a base and an upwardly facing U-shaped flange coupled to the base, the lower channel of the second half of the bracket defined by the base and the upper channel of the second half of the bracket defined by the upwardly facing U-shaped flange, the base of the second half of the bracket having a hollow half cylinder shape and the upwardly facing U-shaped of the second half of the bracket having a rectangular shape with flat and planar sidewalls; and each of the lower channels of the first half of the bracket and the second half of the bracket having a same size and shape and each of the upper channels of the first half of the bracket and the second half of the bracket have a same size and shape.

In one or more embodiments, a method may be summarized as including: coupling a bracket to a pile and a pile cap of a structure, including positioning a lower channel of a first half of the bracket defined by a tubular base with a hollow half cylinder shape of the first half of the bracket around a first portion of the pile, positioning an upper channel of the first half of the bracket defined by an upwardly facing U-shaped flange of the first half of the bracket around a first portion of the pile cap, positioning a lower channel of a second half of the bracket defined by a tubular base with a hollow half cylinder shape of the second half of the bracket around a second portion of the pile opposite to the first portion of the pile, positioning an upper channel of the second half of the bracket defined by an upwardly facing U-shaped flange of the second half of the bracket around a second portion of the pile cap integral with the first portion of the pile cap, and coupling the first half of the bracket to the second half of the bracket around a portion of a circumference of the pile and around a portion of a longitudinal section of the pile cap.

The method may further include: the coupling the first half of the bracket to the second half of the bracket including at least one of coupling at least one nut and bolt assembly to a corresponding at least one tab coupled to the first half of the bracket and at least one tab coupled to the second half of the bracket, welding, coupling a plate to both the first half of the bracket and the second half of the bracket, securing a latch between the first half of the bracket and the second half of the bracket, securing a clamp between the first half of the bracket and the second half of the bracket, and fastening the first half of the bracket and the second half of the bracket to the pile with fasteners; the coupling the first half of the bracket to the second half of the bracket including aligning the lower channel of the first half of the bracket with the lower channel of the second half of the bracket to define a pile channel securable around the portion of the circumference of the pile and aligning the upper channel of the first half of the bracket with the upper channel of the second half of the bracket to define a pile cap channel securable around the portion of the longitudinal section of the pile cap; the positioning the upper channel of the first half of the bracket including arranging the upper channel of the first half of the bracket perpendicular to the lower channel of the first half of the bracket; and the coupling the bracket to the pile and the pile cap of the structure including coupling the bracket to an interface between the pile and the pile cap of the structure.

BRIEF DESCRIPTION OF THE SEVERAL VIEWS OF THE DRAWINGS

The present disclosure will be more fully understood by reference to the following figures, which are for illustrative purposes only. These non-limiting and non-exhaustive embodiments are described with reference to the following drawings, wherein like labels refer to like parts throughout the various views unless otherwise specified. The sizes and relative positions of elements in the drawings are not necessarily drawn to scale in some figures. For example, the shapes of various elements are selected, enlarged, and positioned to improve drawing legibility. In other figures, the sizes and relative positions of elements in the drawings are exactly to scale. The particular shapes of the elements as drawn may have been selected for ease of recognition in the drawings. The figures do not describe every aspect of the teachings disclosed herein and do not limit the scope of the claims.

DETAILED DESCRIPTION

Persons of ordinary skill in the art will understand that the present disclosure is illustrative only and not in any way limiting. Other embodiments of the presently disclosed system and method readily suggest themselves to such skilled persons having the assistance of this disclosure.

Each of the features and teachings disclosed herein can be utilized separately or in conjunction with other features and teachings to provide seismic remediation devices, systems, and methods. Representative examples utilizing many of these additional features and teachings, both separately and in combination, are described in further detail with reference to attached FIGS. 1-9. This detailed description is merely intended to teach a person of skill in the art further details for practicing aspects of the present teachings and is not intended to limit the scope of the claims. Therefore, combinations of features disclosed in the detailed description may not be necessary to practice the teachings in the broadest sense, and are instead taught merely to describe particularly representative examples of the present teachings.

In the description below, for purposes of explanation only, specific nomenclature is set forth to provide a thorough understanding of the present system and method. However, it will be apparent to one skilled in the art that these specific details are not required to practice the teachings of the present devices, systems and methods.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help understand how the present teachings are practiced, but are not intended to limit the dimensions and the shapes shown in the examples in some embodiments. In some embodiments, the dimensions and the shapes of the components shown in the figures are intended to limit the dimensions and the shapes of the components.

While most of the embodiments described below refer to a bracket for a pile and a pile cap of a pile-supported structure that is at least partially submerged in water (i.e., a pier, wharf, bridge, and the like), in other embodiments, the brackets may be adapted for vertical supports or columns and beams or caps of land-based structures.

Figure 1:
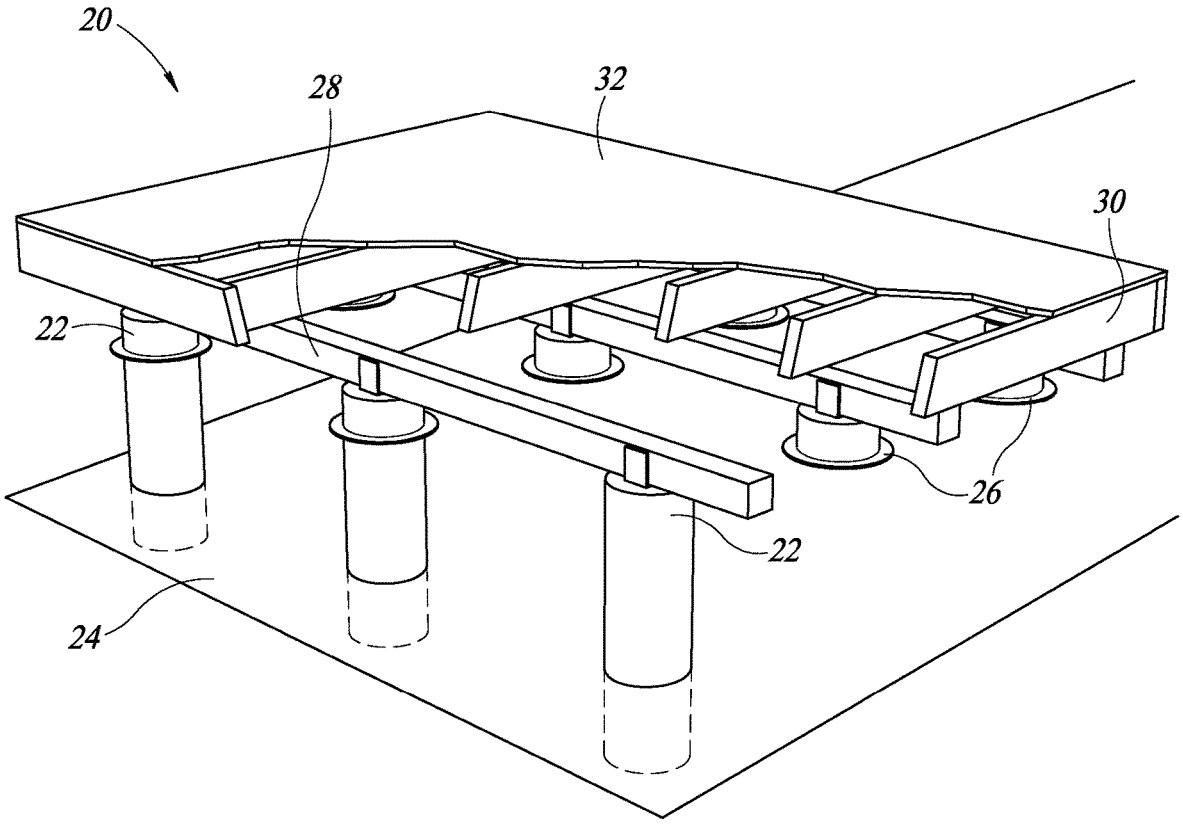
FIG. 1 (PRIOR ART)
FIG. 1 is a perspective cut-away view of a known wood pile supported structure.

Beginning with FIG. 1, illustrated therein is a known pile supported structure 20 such as a pier, wharf, or dock. In the example shown in FIG. 1, the piles 22 are wood piles driven into a ground surface 24 and at least partially submerged under water as indicated by rings 26 near the top of the piles 22. The piles 22 are coupled to one or more pile caps 28 spanning the piles 22. Stringers 30 are coupled to the pile caps 28 and run across the pile caps 28. A deck surface 32 is coupled to the stringers 30 to create the structure 20.

During a seismic event, the structure 20 will experience repeated cycles of up and down movements, as well as potential side to side movements, that are concentrated at the interface between the piles 22 and the pile caps 28. As explained above, the piles 22 can separate from the pile caps 28 as a result of this up and down movement and the concern becomes whether the piles 22 will land squarely, if at all, under the pile caps 28. With each seismic wave that passes through the structure 20, the probability that the piles 22 land squarely with the pile caps 28 decreases. If the piles 22 do not land squarely with the pile caps 28, the structure 20 can collapse and pose a safety risk to people or objects on the deck 32 and near the structure 20. Alternatively, if some of the piles 22 remain connected to the pile caps 28 while some are disconnected, as above, then the structure 20 will not be able to support the intended load and access to the structure 20 will likely need to be restricted until the structure 20 can be adequately repaired. These type of repairs represent a significant expense and hassle for owners as well as a loss of use of the structure 20 for an extended period.

Figure 2:
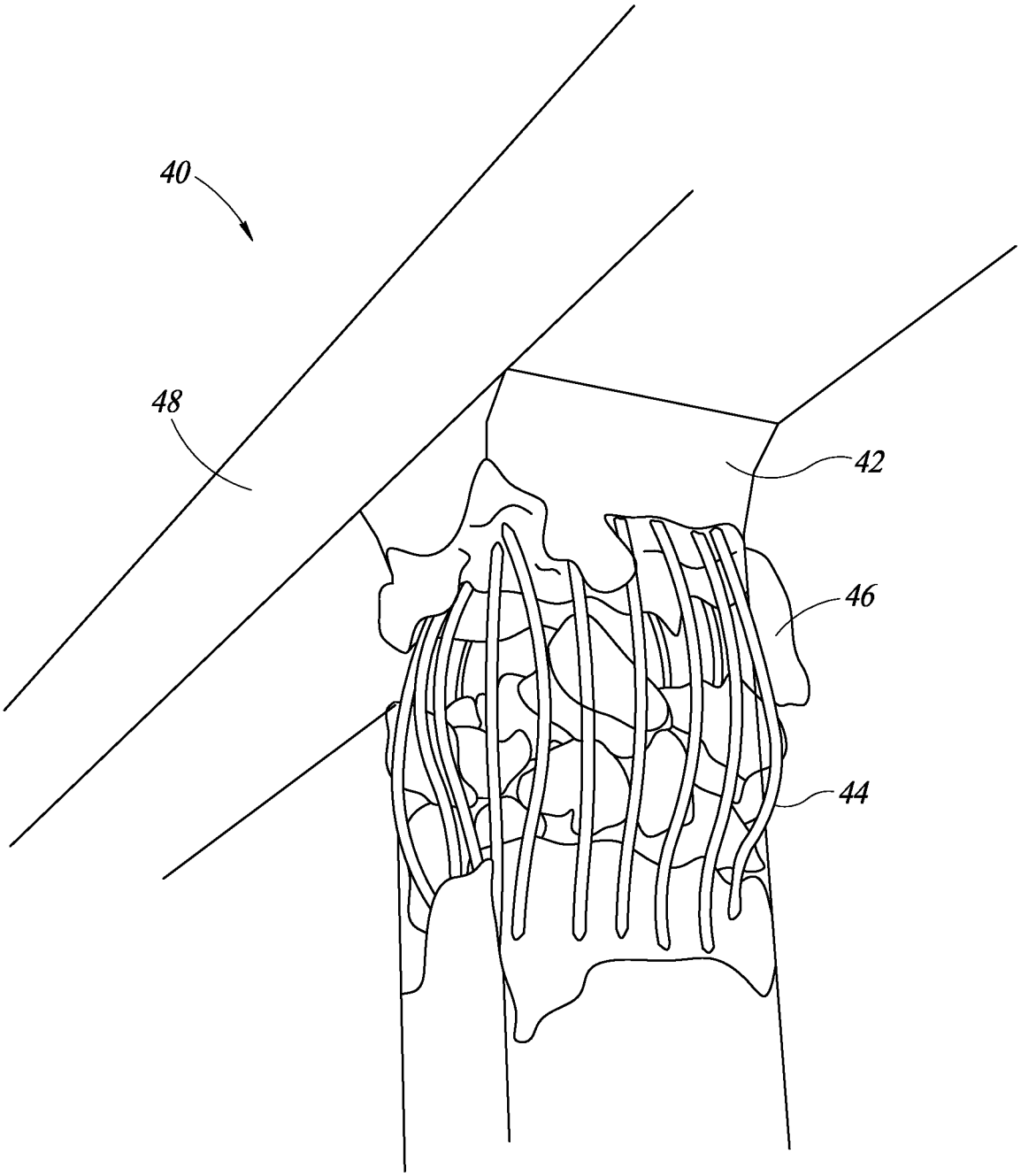
FIG. 2 (PRIOR ART)
FIG. 2 is a perspective view of a known pile supported structure showing failure of the pile as a result of seismic forces.

FIG. 2 illustrates a known pile supported structure 40 showing failure of the pile as a result of a seismic event. In particular, the structure 40 includes a pile 42, which may be a concrete or steel pile. The pile 42 includes rebar or steel 44 encased in concrete 46 and may likewise be driven into the ground, as with piles 22, or may be supported by footings or other typical support structures. The pile 42 is coupled to a pile cap 48, which may in turn be connected to stringers and a deck (not shown) as with a pier or wharf, or may be connected directly to a deck as with a highway overpass in some non-limiting examples. During a seismic event, the up and down movement of the pile 42 and the pile cap 48 is concentrated at the connection between the pile 42 and the pile cap 48.

Although the rebar 44 improves the properties of the concrete 46 when the pile 42 is subjected to tension forces, the concrete material 46 itself is known to be weak under applied tensile forces. During a seismic event, the repeated up and down motion from the seismic waves produces repeated cycles of tensile and compressive forces on the concrete that are concentrated at the connection between the pile 42 and the pile cap 48. As a result, the concrete 46 is likely to crumble, leaving only the rebar 44 to support the pile cap 48 and the structure 40, as shown in FIG. 2. In some cases, the rebar 44 may prevent a total collapse of the structure 40, but access to the structure 40 will be restricted while the structure 40 undergoes time consuming and expensive repairs. In some cases, the rebar 44 is too weak to support the remaining load and the structure 40 will collapse. In either situation, the failure of the concrete due to a seismic event poses a safety concern to those on or near the structure 40.

Further, remediation of the above structures 20, 40 is difficult and expensive because it typically requires disassembly of the structures 20, 40 and installation of specialized remediation devices that resist forces during a seismic event. This process has high labor and material costs while also restricting access to the structure for an extended period of time, which can cause a loss of revenue for the owner of the structure or negative impacts on local infrastructure in some non-limiting examples.

Figure 3A:
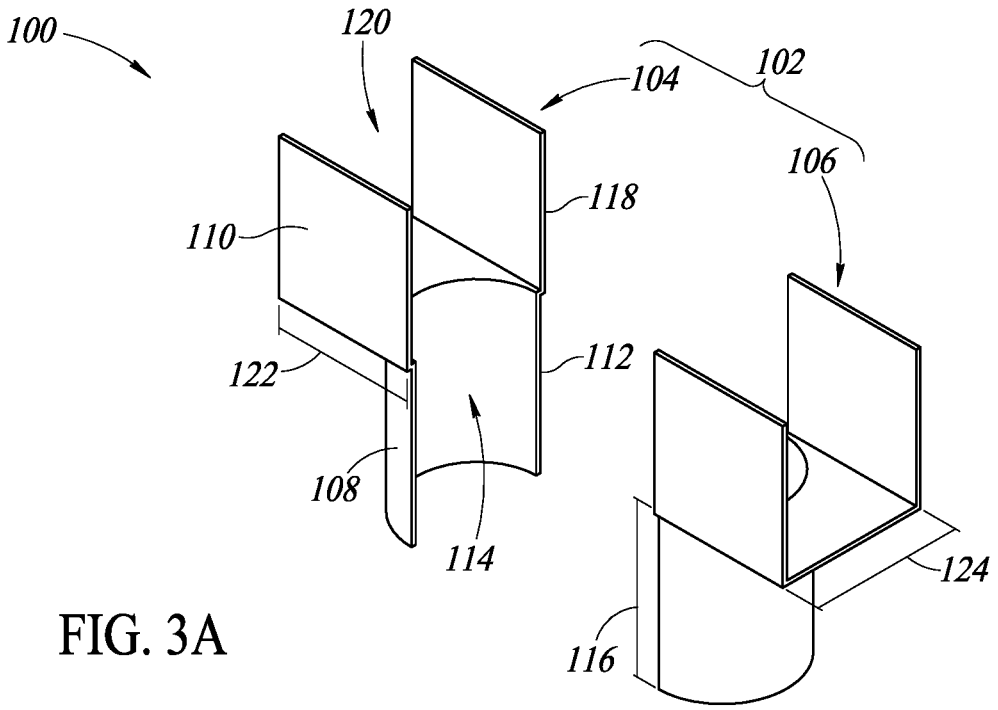
FIG. 3A is an upper perspective view of a bracket structured to be coupled to an interface between a pile and a pile cap of a structure according to an embodiment of the present disclosure.
Figure 3B:
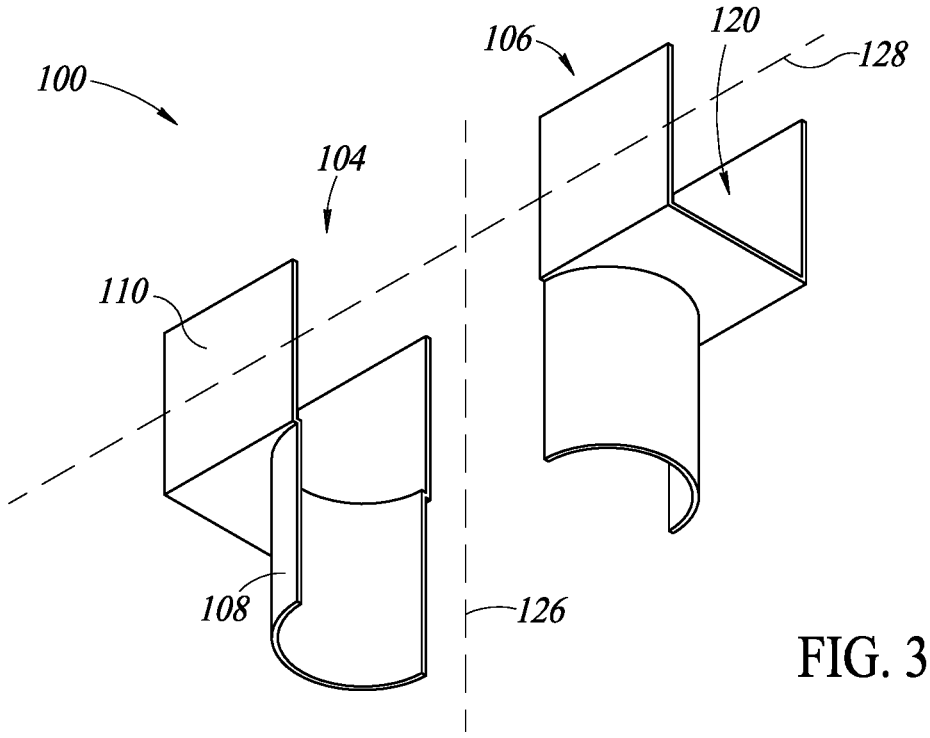
FIG. 3B is a lower perspective view of a bracket structured to be coupled to an interface between a pile and a pile cap of a structure according to an embodiment of the present disclosure.

FIG. 3A and FIG. 3B illustrate one or more embodiments of a seismic remediation device or system 100 (which may also be referred to herein as a bracket 100 or a seismic bracket 100) structured to be coupled to an existing pile supported structure to remediate the above concerns. Beginning with FIG. 3A, the bracket 100 includes a body 102 with a first half 104 and a second half 106. The halves 104, 106 are structured to be coupled together around the pile and pile cap of a structure, as explained further below. The first half 104 of the body 102 includes a tubular base 108 coupled to a flange 110. The base 108 may have a hollow half cylinder shape with curved or angled sidewalls 112 that define a lower channel 114. The base 108 also includes a height 116 from the bottom to the top of the base 108 with the lower channel 114 extending through the base 108 over the entire height 116 of the base 108 from the bottom to the top of the base 108. The radius of curvature of the sidewalls 112 of the base 108 as well as the size and shape of the base 108 can be selected based on design factors, such as the radius, diameter, size, or shape, or any combination thereof, of a pile of a structure to which the bracket 100 will be attached, among others. In some embodiments, the lower channel 114 has a constant radius or depth over the entire height 116 of the base 108. Alternatively, the lower channel 114 may have a radius or depth that changes over the height 116 of the base 108 to correspond to a shape of the pile to which the bracket 100 is attached. In some non-limiting examples, the radius or depth of the lower channel 114 may taper or may have a step-down or step-up configuration.

The flange 110 may have an upward facing "U" shape with flat and planar sidewalls 118 and a flange base 119. The sidewalls 118 are parallel or substantially parallel to each other. Additionally, the sidewalls 118 are perpendicular or substantially perpendicular to the flange base 119. Together the sidewalls 118 and a flange base 119 define an upper channel 120. Thus, as defined herein, the upward facing "U" shaped flange 110 typically has perpendicular lower corners, not rounded corners of a traditional "U" shape. However, the flange 110 is configured to conform to the bottom section of a pile cap. Accordingly, in an embodiment where the bottom section of a pile cap has rounded corners, the corresponding section of the flange has rounded corners as well.

The upper channel 120 is open at the top of the bracket 100 to receive at least a portion of a pile cap, as explained further below. Further, the flange 110 includes a length 122 and a width 124. The upper channel 120 extends through the flange 110 over the entire length 122 and width 124 with the dimensions of the upper channel 120 being constant over the entire length 122 and width 124. In one or more embodiments where the pile cap has an unusual shape, the length and width 122, 124 of the flange 110 may change over the length and width 124. In some non-limiting examples, the upper channel 120 may taper or may have a step-down or step-up configuration over the length 122 and width 124 of the upward facing U-shaped flange 110. The length 122 of the upward facing U-shaped flange 110 may also be greater than, equal to, or less than the width 124 of the upward facing U-shaped flange 110. Further, the length 122 or the width 124, or both, may be greater than, equal to, or less than the height 116 of the base 108. As with the base 108, the size and shape of the upward facing U-shaped flange 110 may be selected based on design factors, such as the dimensions, size, or shape, or any combination thereof, of a pile cap received in the upper channel 120.

Although the above description focuses on the first half 104 of the body 102 of the bracket 100, it is to be appreciated that the second half 106 of the body 102 of the bracket 100 is a mirror image and may have the same features, aspects, and characteristics as the first half 104 of the bracket 100. In one or more embodiments, the second half 106 of the body 102 of the bracket 102 may have a different size or shape, or both, than the first half 104 of the body 102 of the bracket 102, such as when the pile or pile cap has an irregular shape. Further, where the bracket 100 is intended to be used with the last pile in a given series (i.e., a corner pile), the first half 104 or the second half 106 of the body 102 of the bracket 100 may include only the base 108 but not the upward facing U-shaped flange 110, or the height 116 of the base 108 may be greater than the length 122 of the upward facing U-shaped flange 110 of either half 104, 106 of the body 102 of the bracket 100 due to the termination of the pile cap at the corner location. In some embodiments, the first half 104 or the second half 104 of the body 102 of the bracket 100 may replace the upwardly facing U-shaped flange 110 with an upwardly facing corner-shaped flange corresponding to a shape of the pile cap where the pile cap terminates at the corner location.

Where the pile has an irregular shape, such as a pile with a tapered diameter decreasing from a top to a bottom of the pile or a step-down configuration, among others, the bracket 100 may further include a seal between the bracket 100 and the pile. More specifically, the base 108 of one or both halves 104, 106 of the body 102 of the bracket 100 may include a strip of material a bottom of the base 108 for creating a seal between the base 108 and the pile. The strip of material may be foam or another like material and may include an adhesive in some embodiments for securing the strip of material to the pile. The base 108 of one or both halves 104, 106 of the bracket 100 further includes two valves or ports. A first valve is positioned above the layer of material proximate the bottom of the base and a second valve is positioned near a top of the base 108 proximate the flange 110.

Once the bracket 100 is in position on the pile with the strip of material creating a seal at the bottom of the bracket, an epoxy grout or another like hard setting material can be pumped into the first or lower valve. The air in the void between the bracket 100 and the pile is displaced as the grout fills the void with the air being vented through the second valve at the top of the base 108 of one or both halves 104, 106 of the bracket. In some embodiments, the grout is pumped into the first valve until the grout reaches the second valve, although the same is not necessarily required and any selected amount of grout can be pumped into the void through the first valve. The flange 110 of one or both halves 104, 106 of the body 102 of the bracket 100 may include similar features, such as a strip of material for forming a seal and valves, to accommodate pile caps with an irregular shape in some embodiments. Further, the bracket 100 including the valves 100 is particularly well adapted for use with concrete piles in some embodiments, although the concepts can also be employed with any type of pile.

Moreover, the bracket 100 may be formed of any material now known or discovered in the future. For example, the bracket 100 may be formed of any material currently listed, or listed in the future, in the American Society for Testing Materials ("ASTM") standards, specifications, technical papers, or books. In some non-limiting examples, the bracket may be formed of structural steel or structural aluminum with the dimensions (i.e., length, width, height, web thickness, etc.) selected based on the factors above in addition to engineering design factors. The dimensions may be constant for both halves 104, 106 of the body 102 of the bracket 100 or may change over the halves 104, 106 of the body 102 of the bracket 100, such as when a higher web thickness is selected for the base 108 and the bottom of the upward facing U-shaped flange 110 relative to the sides of the upward facing U-shaped flange 110 to further resist localized stress and strain at the interface between the pile and the pile cap. In yet further non-limiting examples, the bracket 100 may be formed of any material with a modulus of elasticity higher than concrete.

FIG. 3B is a bottom perspective view illustrating additional details of the bracket 100. In particular, FIG. 3B illustrates a vertical axis 126 and a horizontal axis 128 in dashed lines. In some embodiments, the base 108 of each half 104, 106 of the body 102 of the bracket 100 is arranged along the vertical axis 126 with the bracket 100 centered with respect to the vertical axis 126. Further, the upward facing U-shaped flange 110 of each half 104, 106 of the body 102 of the bracket 100 is arranged along the horizontal axis 128 with the horizontal axis 128 centered with respect to the upper channel 120 defined by the upward facing U-shaped flange 110. Thus, the base 108 is perpendicular with respect to the upward facing U-shaped flange 110. In one or more embodiments, the base 108 is arranged at a selected angle to the vertical axis 126 and the upward facing U-shaped flange 110 in order to accommodate an angular pile. In some non-limiting examples, the angle between the base 108 and the vertical axis 126 is 5 degrees, 10 degrees, 15 degrees, 20 degrees, 25 degrees, 30 degrees, 35 degrees, 40 degrees, or 45 degrees or more. The upward facing U-shaped flange 110 may similarly be at a selected angle, such as any of the angles listed above or others, relative to the horizontal axis 128 and the base 108 in order to accommodate angled, sloped, or curved pile caps.

Figure 4:
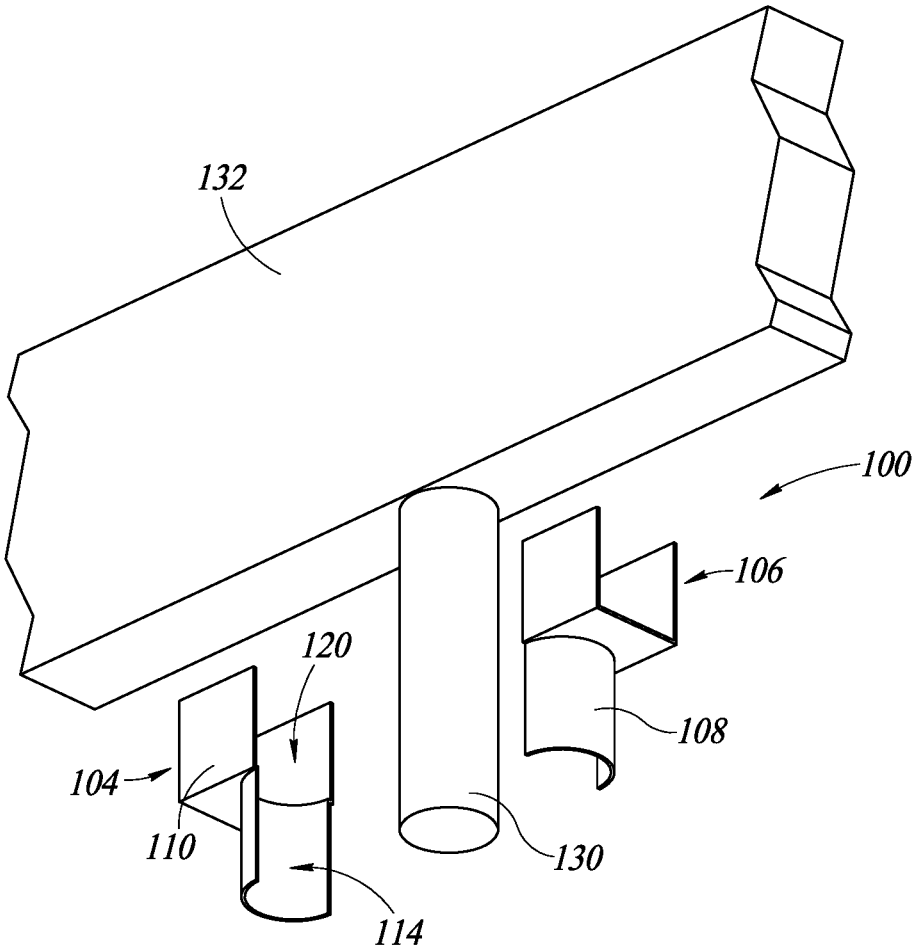
FIG. 4 is a perspective view of the bracket of FIG. 3A and FIG. 3B aligned with a portion of the pile and a portion of the pile cap of the structure prior to coupling the bracket to the structure.

FIG. 4 is a perspective view of the bracket 100 illustrating an initial alignment step during use or installation of the bracket. Because the bracket 100 includes the body 102 (FIG. 3A) with two halves 104, 106, the bracket 100 can be coupled to an existing pile 130 and pile cap 132 with significantly reduced costs relative to known seismic remediation devices because installing the bracket 100 does not require disassembly of any part of the structure. Further, the material cost for the halves of the bracket 100 is economical relative to other solutions. As shown in FIG. 4, the first half 104 and the second half 106 of the body 102 (FIG. 3A) of the bracket 100 are positioned with the base 108 of each half 104, 106 aligned with a portion of the pile 130 proximate an interface between the pile 130 and the pile cap 132. Similarly, the upward facing U-shaped flange 110 of each half 104, 106 of the bracket 100 is aligned with a portion of the pile cap 132 on opposite sides of the interface between the pile 130 and the pile cap 132. The lower channel 114 in each half 104, 106 of the bracket 100 is structured to receive the above-referenced portion of the pile 130. More specifically, the lower channel 114 of the first half 104 of the bracket 100 is structured to receive a first half of the pile 130 proximate the interface between the pile 130 and the pile cap 132 and the second half 106 of the bracket 100 is structured to receive a second half of the pile 130 opposite to the first half. The upper channel 120 in each half 104, 106 of the bracket 100 is structured to receive a portion of the pile cap 132 on either side of the pile 130. Thus, the lower channels 114 may cooperate to define a pile channel structured to receive at least a portion of the pile 130 and the upper channels 120 may cooperate to define a pile cap channel structured to receive at least a portion of the pile cap 132. Further installation steps are described below with reference to FIG. 5A-5E, which show the bracket 100 coupled to the pile 130 and the pile cap 132.

Figure 5A:
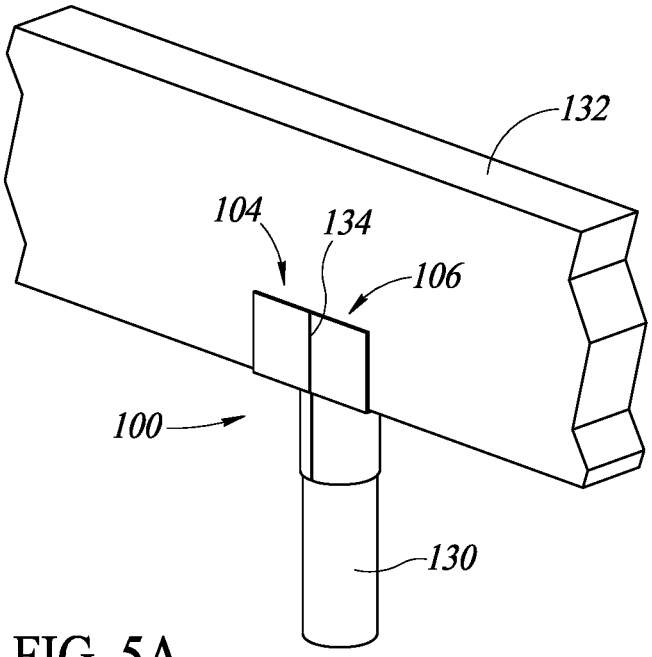
FIG. 5A is an upper perspective view of the bracket of FIG. 3A and FIG. 3B coupled to a pile supported structure.

FIGS. 5A-5E are various views of the bracket 100 coupled to the pile 130 and the pile cap 132, which may be a wood pile and a wood pile cap, respectively. Beginning with FIG. 5A, the halves 104, 106 of the bracket 100 are positioned around the pile 130 and the pile cap 132, as explained above. The sidewalls of each half 104, 106 of the bracket 100 are proximate to, adjacent to, or in abutting contact with, each other at the interface between the halves 104, 106. In some embodiments, as in FIGS. 5A-5E, the two halves 104, 106 may then be welded together to complete installation of the bracket 100. As shown in FIG. 5A, the welded connection between the halves 104, 106 of the bracket 100 is represented by solid line 134. The welded connection 134 may be any type or style of weld performed by any welding method now known or developed in the future, including any weld approved for structural support applications.

Figure 5B:
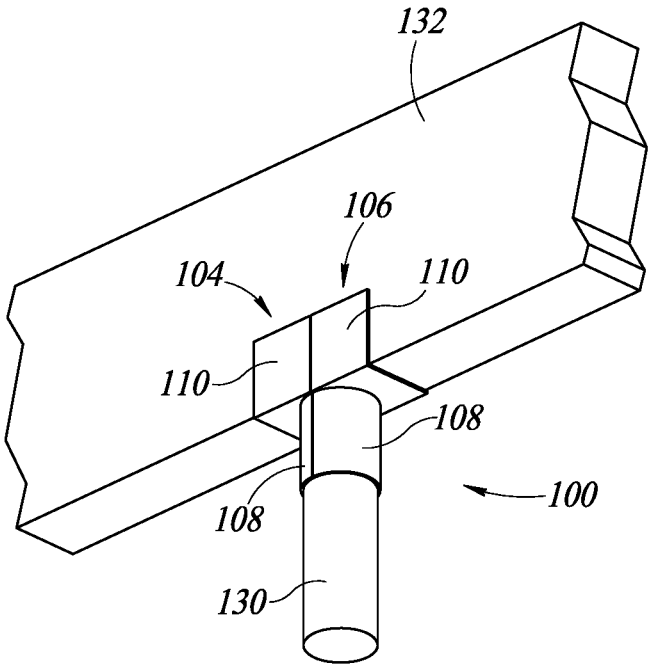
FIG. 5B is a lower perspective of the bracket of FIG. 3A and FIG. 3B coupled to a pile supported structure.

FIG. 5B illustrates additional detail of the bracket 100 connected to the pile 130 and the pile cap 132. As shown in FIG. 5B, the bases 108 of each half 104, 106 of the bracket 100 cooperate to receive a portion of the pile 130 proximate the interface between the pile 130 and the pile cap 132. As mentioned above, the bases 108 of each half 104, 106 can extend from the interface between the pile 130 and the pile cap 132 by a selected distance along the pile 130. In some limiting examples, the bases 108 of each half 104, 106 of the bracket 100 extend 1 inch, 2 inches, 3 inches, 4 inches, 5 inches, 6 inches, 7 inches, 8 inches, 9 inches, 10 inches, 15 inches, or 20 inches or more. Further, the upward facing U-shaped flanges 110 of each half 104, 106 of the bracket 100 cooperate to receive the pile cap 132 on opposite sides, and surrounding, the interface between the pile 130 and the pile cap 132. The length of the upward facing U-shaped flanges 110 on each side of the interface between the pile 130 and the pile cap 132 can be any of the dimensions listed above for the bases 108 of each half 104, 106 of the bracket 100 in some non-limiting examples. Further, the upward facing U-shaped flange 110 of each half 104, 106 of the bracket 100 extends vertically along the pile cap 132 by a selected distance, or in other words, the upward facing U-shaped flange 110 of each half 104, 106 of the bracket 100 has a selected height, as explained above.

Figure 5C:
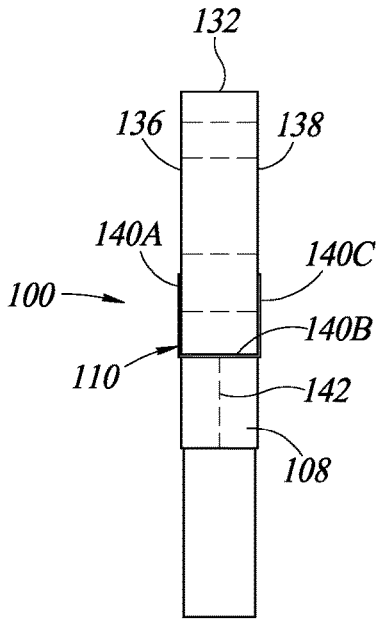
FIG. 5C is a side view of the bracket of FIG. 3A and FIG. 3B coupled to a pile supported structure.

FIG. 5C is a front elevational view showing the bracket 100 extending on both sides of the pile cap 132. In particular, the pile cap 132 includes a first side 136 and a second side 138 opposite to the first side 136. In some embodiments, the first side 136 of the pile cap 132 is a front major side and the second side 138 is a rear major side of the pile cap 132. The upward facing U-shaped flange 110 of each half 104, 106 (FIG. 5B) of the bracket 100 includes a first sidewall 140A, a base 140B, and a second sidewall 140C. The first and second sidewalls 140A, 140C of each upward facing U-shaped flange 110 of each half 104, 106 of the bracket 100 extend vertically along the first and second sides 136, 138 of the pile cap 132, respectively. The base 140B of each upward facing U-shaped flange 110 receives a bottom surface of the pile cap 132 and extends across a width or thickness of the pile cap 132 between the sidewalls 140A, 140C of each upward facing U-shaped flange 110. As such, the first and second sidewalls 140A, 140C are perpendicular to the base 140B in some embodiments. Alternatively, the first and second sidewalls 140A, 140C may be at any selected angle to the base 140B in order to accommodate a pile cap 132 with a corresponding shape, such as a pile cap 132 with angled sides 136, 138. Further, each sidewall 140A, 140C may be the same size and have the same orientation relative to the base 140B or the sidewalls 140A, 140C may be different sizes and shapes and with different orientations relative to the base 140B.

Moreover, FIG. 5C illustrates an embodiment of the bracket 100 with a different arrangement of the upward facing U-shaped flange 100. In particular, dashed line 142 may be a weld line in embodiments where the bracket 100 includes each half 104, 106 having the upward facing U-shaped flange 110 with an "L" shape instead of the "U" shape described above. In such embodiments, each upward facing U-shaped flange 110 of each half 104, 106 of the bracket 100 includes only one sidewall 140A, 140C and a portion of the base 140B of the upward facing U-shaped flange 110 with the weld line represented by dashed line 142. In yet a further embodiment, the bracket 100 may have more than two halves, such as three, four, or more parts that are coupled to each other around the pile 130 and the pile cap 132.

Figure 5D:
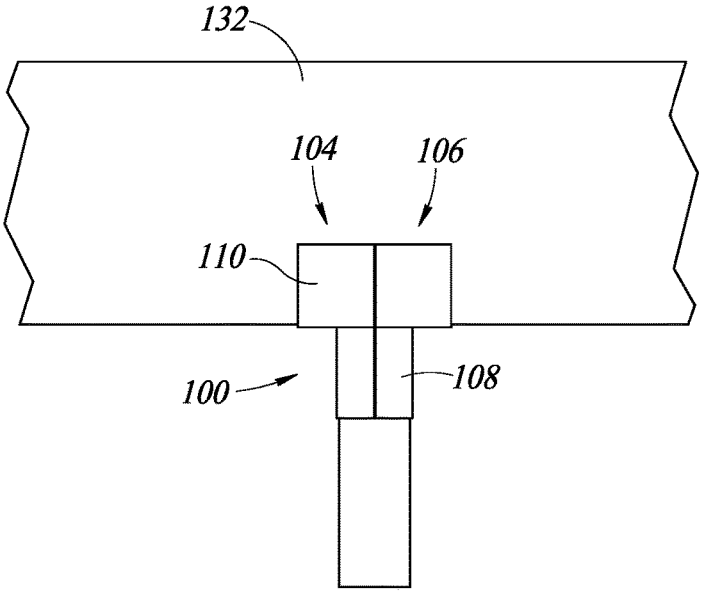
FIG. 5D is a front view of the bracket of FIG. 3A and FIG. 3B coupled to a pile supported structure.

FIG. 5D is an elevational view of the bracket 100 coupled to the pile 130 and the pile cap 132. As shown in FIG. 5D, and with reference to FIGS. 5A-5C, the sidewalls 140A, 140C and base 140B of each upward facing U-shaped flange 110 of each half 104, 106 of the bracket 100 may be flat and planar and form a rectangular shape aligned with the major surfaces 136, 138 of the pile cap 132. Further, the upward facing U-shaped flange 110 may extend beyond an outer peripheral edge of the base 108 of each half 104, 106 of the bracket 100, although the same is not necessarily required.

Figure 5E:
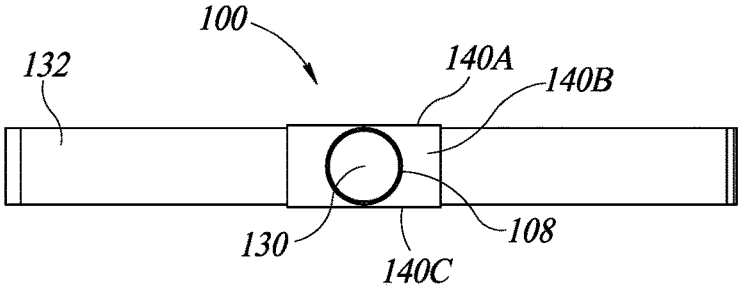
FIG. 5E is a bottom view of the bracket of FIG. 3A and FIG. 3B coupled to a pile supported structure.

FIG. 5E is a bottom plan view of the bracket 100 illustrating the base 140B of each upward facing U-shaped flange 110 of each half 104, 106 of the bracket 100 extending across the entire width or thickness of the pile cap 132 between the sidewalls 140A, 140C. Further, the base 140B of each upward facing U-shaped flange 100 surrounds the interface between the pile 130 and the pile cap 132. FIG. 5E also shows the base 108 of each half 104, 106 of the bracket 100 cooperating to extend around an entirety of the pile 130.

Figure 6A:
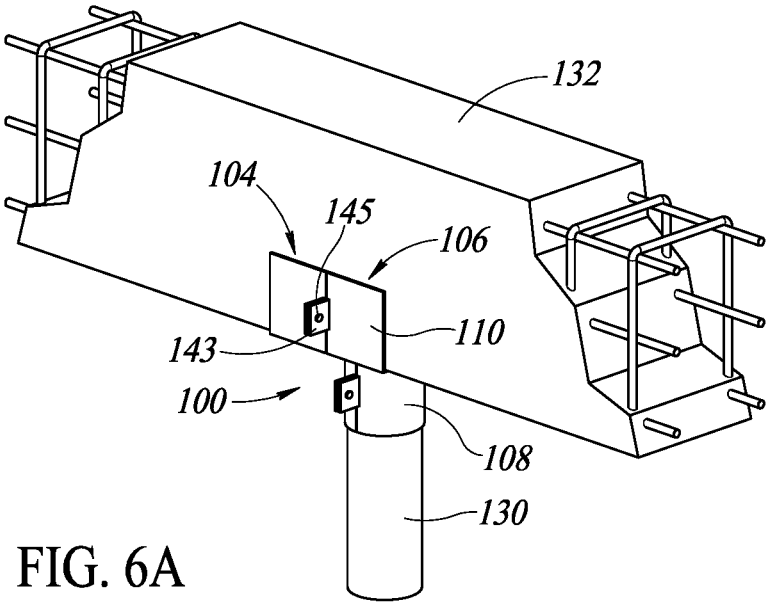
FIG. 6A is an upper perspective view of the bracket of FIG. 3A and FIG. 3B coupled to a concrete pile supported structure.
Figure 6B:
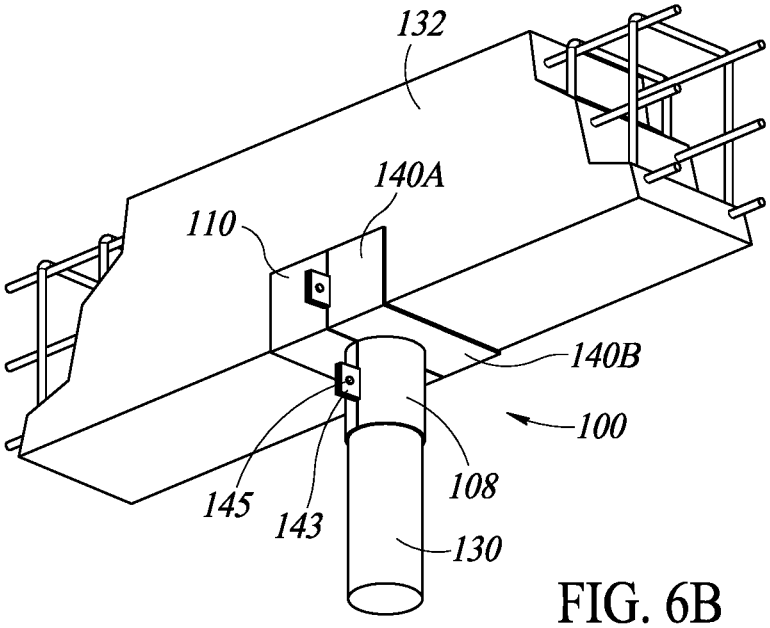
FIG. 6B is a lower perspective views of the bracket of FIG. 3A and FIG. 3B coupled to a concrete pile supported structure.

FIG. 6A and FIG. 6B are perspective views of the bracket 100 coupled to the pile 130 and the pile cap 132, which may be concrete or steel. As shown in FIG. 6A, the halves 104, 106 of the bracket 100 are coupled to the pile 130 and the pile cap 132 in a similar manner, regardless of the type of pile 130 and pile cap 132. Turning to FIG. 6B, the dimensions of aspects of the bracket 100 may adapted for a concrete or steel pile 130 and pile cap 132. Specifically, FIG. 6B shows the base 140B of each upward facing U-shaped flange 110 of each half 104, 106 of the bracket 100 having a greater length to accommodate a wider concrete pile cap 132. The width of the base 140B may be greater than the length of the base 108 and the sidewalls 140A, 140B of the upward facing U-shaped flange 110 of each half 104, 106 of the bracket 100, as in FIG. 6B. Thus, the dimensions of the bracket 100 can be selected to correspond to the intended size, shape, and type of pile 130 and pile cap 132.

In some embodiments shown in FIG. 6A and FIG. 6B, each of the halves 104, 106 of the bracket 100 include tabs 143 coupled to the bracket 100 that receive nut and bolt assemblies 145 to couple the two halves 104, 106 together. More specifically, the upward facing U-shaped flange 110 of each half 104, 106 of the bracket 100 includes a tab 143 coupled to the respective upward facing U-shaped flange 110 with the tabs 143 of the upward facing U-shaped flanges 110 of the halves 104, 106 of the bracket 100 aligning with each other when the bracket 100 is positioned around the pile cap 132. Similarly, the base 108 of each half 104, 106 of the bracket 100 includes a tab 143 coupled to the respective base 108 with the tabs 143 of the bases 108 of the halves 104, 106 of the bracket 100 aligning with each other when the bracket 100 is positioned around the pile 130. The tabs 143 may include one or more holes for receiving the nut and bolt assemblies 145. As shown in FIG. 6A and FIG. 6B, the tabs 143 each include a centrally located hole for receiving the nut and bolt assemblies 145. In some embodiments, there may be more than one hole in each tab 143 and more than one nut and bolt assembly 145 inserted through the corresponding number of holes.

Although only one side of the bracket 100 is shown in FIG. 6A and FIG. 6B, it is to be appreciated that the opposite side of the bracket 100 is a mirror image and thus similarly includes tabs 143. Thus, the upward facing U-shaped flange 110 of each half 104, 106 of the bracket includes two tabs positioned on opposite sides of the upward facing U-shaped flange 110 and the base 108 of each half 104, 106 of the bracket includes two tabs positioned on opposite sides of the base 108 for a total of eight tabs coupled to the bracket 100. In some embodiments, there are more or less than eight tabs 143, such as two, four, six, ten, twelve, fourteen, sixteen, eighteen, twenty or more tabs 143. Further, the number of tabs 143 coupled to the base 108 and the upward facing U-shaped flange 110 of each half 104, 106 of the bracket as well as the position of the tabs 143 relative to the base 108 and the upward facing U-shaped flange 110 of each half 104, 106 may be selected and may be the same or different between the different aspects of the bracket 100. In some non-limiting examples, the bracket 100 includes each half 104, 106 including four tabs 143 coupled to the base 108 and only two tabs 143 coupled to the upward facing U-shaped flange 110, or vice versa. The tabs 143 may extend from the base 108 and the upward facing U-shaped flange 110 perpendicularly or substantially perpendicularly in one or more embodiments to facilitate insertion of the nut and bolt assemblies, although the same is not necessarily required and the tabs 143 can be positioned at any selected angle relative to the base 108 and the upward facing U-shaped flange 110 of each half 104, 106 in one or more embodiments. In other embodiments, the tabs 143 are placed at an obtuse angle from the base 108 to which they attached (i.e., leaning in towards the opposing tab), so that when securing the opposing tabs 143 to one another, force is generated that drives each half 104, 106 of the upward facing U-shaped flange 110 and base 108 towards one another.

In some embodiments, the tabs 143 are positioned only on the base 108 of each half 104, 106 of the bracket 100 or only on the upward facing U-shaped flange 110 of each half 104, 106 of the bracket 100. However, it is preferred that both the base 108 and the upward facing U-shaped flange 110 of each half 104, 106 of the bracket 100 include tabs 143 to provide a secure connection between the halves 104, 106 of the bracket 100. Although not specifically shown in FIG. 6B, the base 140B of the upward facing U-shaped flange 110 of half 104, 106 of the bracket 100 similarly includes tabs 143 and nut and bolt assemblies 145 on either or both opposite sides of the base 108 in one or more embodiments. The tabs 143 may be provided with or without additional coupling devices, systems, and methods in some embodiments. For example, the tabs 143 may be used in addition to the welded connection between the halves 104, 106 of the bracket 100 described above, or with any of the other coupling device, systems, or methods described herein. Alternatively, the bracket 100 may include only the tabs 143 without welding or any additional coupling device, system, or method in one or more embodiments.

Figure 6C:
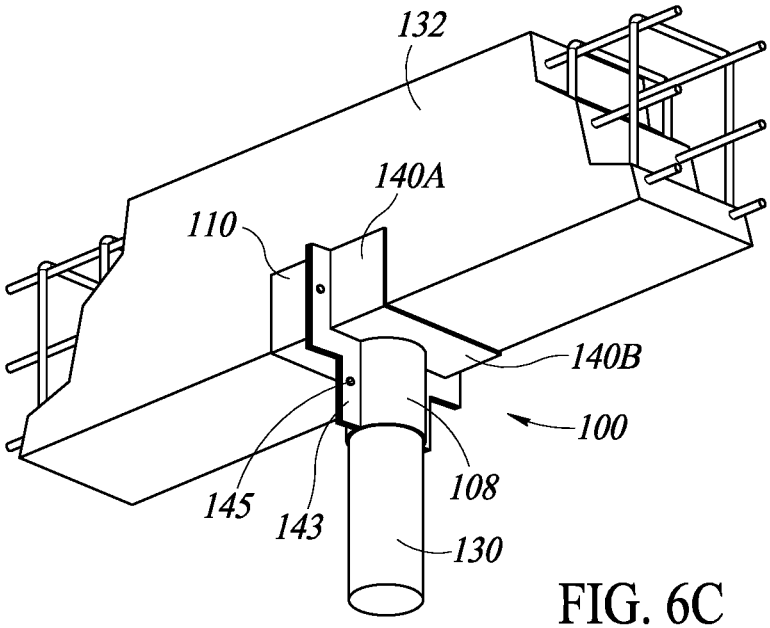
FIG. 6C is a perspective views of the bracket of FIG. 3A and FIG. 3B coupled to a concrete pile supported structure.

FIG. 6C shows an embodiment similar to FIGS. 6A and 6B, except that instead of tabs located along the edge of each half 104, 106 of the bracket 100 and each half of the base 108, a flange 143 is deposed along the edge of each half 104, 106 of the bracket 100 and each half of the base 108. In one or more embodiments shown in FIG. 6C, each of the halves 104, 106 of the bracket 100 include tabs 143 coupled to the bracket 100 that receive nut and bolt assemblies 145 to couple the two halves 104, 106 together. More specifically, the upward facing U-shaped flange 110 of each half 104, 106 of the bracket 100 includes a vertical flange 143 coupled to the respective upward facing U-shaped flange 110 with the vertical flange 143 of the upward facing U-shaped flanges 110 of the halves 104, 106 of the bracket 100 aligning with each other when the bracket 100 is positioned around the pile cap 132. Similarly, the base 108 of each half 104, 106 of the bracket 100 includes a vertical flange 143 coupled to the respective base 108 with the vertical flanges 143 of the bases 108 of the bracket halves 104, 106 aligning with each other when the bracket 100 is positioned around the pile 130. The vertical flanges 143 may include one or more holes for receiving the nut and bolt assemblies 145. As shown in FIG. 6C, the vertical flanges 143 each include one or more centrally located holes for receiving the nut and bolt assemblies 145. In some embodiments, there are more than one hole in each vertical flange 143 and more than one nut and bolt assembly 145 inserted through the corresponding number of holes.

Figure 7:
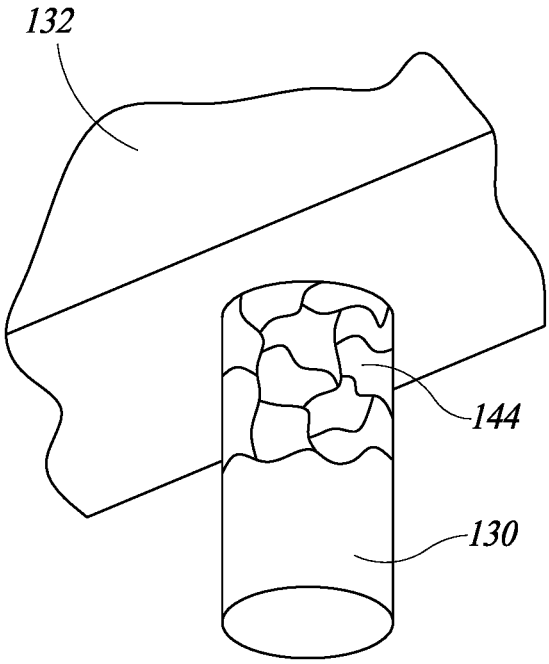
FIG. 7 is a perspective view of the concrete pile supported structure of FIG. 6A and FIG. 6B showing the effects of a seismic event on the concrete pile that employs concepts of the present disclosure.

FIG. 7 is a perspective view of the concrete pile 130 and concrete pile cap 132 after a seismic event occurs with the bracket 100 around the interface between the pile 130 and the pile cap 132. The bracket 100 is removed to avoid obscuring details of the disclosure. As shown in FIG. 7, concrete 144 of the pile 130 remains in place after the seismic event due to the benefits of the bracket 100. Although the concrete 144 may crack as a result of the seismic event, the concrete 144 is held in place by the bracket 100 to prevent the concrete 144 from falling away and exposing the rebar. In this configuration (i.e., with the concrete 144 encased in the bracket 100), the cracking in the concrete 144 does not prevent the concrete 144 from continuing to support most, if not all, of its intended load because the cracked concrete material is still able to resist compressive forces on the concrete 144.

Moreover, the bracket 100 limits further damage and failure of the interface between the pile 130 and the pile cap 132 for any type of pile and pile cap (i.e., formed of any material) because the bracket 100 has a higher modulus of elasticity than the pile 130 and the pile cap 132 and can better resist deformation resulting from the stresses applied by the seismic event at the interface between the pile 130 and the pile cap 132. As a result, the bracket 100 also prevents the pile 130 from separating from the pile cap 132, which is of particular importance when the pile 130 and the pile cap 132 are wood. As such, the use of the bracket 100 during a seismic event enables the structure to continue supporting most of, or all, of its intended load to reduce the risk of harm to persons and objects on the structure or near the structure until the structure can be safely repaired. Further, the bracket 100 reduces the overall amount of damage to the pile 130 and the pile 132, thus reducing the cost of repairs. The bracket 100 can also be manufactured and installed at considerably less cost than other known seismic remediation devices because installation does not involve disassembling the pile 130 and the pile cap 132, or any part of the structure.

FIGS. 8A-8F are perspective views of embodiments of a bracket coupled to an interface between a pile and a pile cap of a structure. Except as otherwise provided below, the brackets in FIGS. 8A-8E are identical to the bracket 100 described above with reference to FIGS. 3A-7.

Figure 8A:
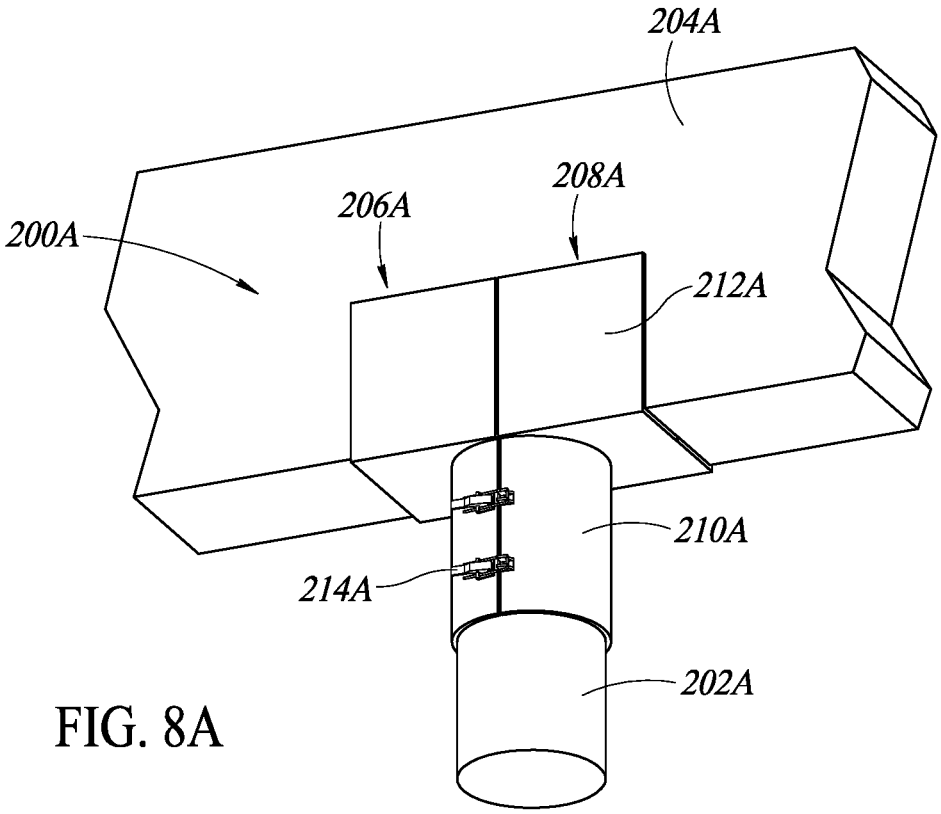
FIG. 8A is a perspective view of a two halves of the bracket coupled to each other via latches around a pile and a pile cap of a structure according to one or more embodiments of the present disclosure.

Beginning with FIG. 8A, a bracket 200A is coupled to a pile 202A and a pile cap 204A at the interface between the pile 202A and the pile cap 204A. The bracket 200A includes a first half 206A coupled to a second half 208A with each half 206A, 208A including a base 210A coupled to an upward facing U-shaped flange 212A. In FIG. 8A, the halves 206A, 208A of the bracket 200A are coupled together with one or more latches or further brackets 214A instead of, or in addition to, a welded connection between the halves 206A, 208A of the bracket 200A. Although the latches 214A are shown as coupled between the base 210A of each half 206A, 208A of the bracket 200A, the latches 214A may be positioned to couple any portion of the bracket 200A, including the upward facing U-shaped flange 212A of each half 206A, 208A of the bracket 200A.

Figure 8B:
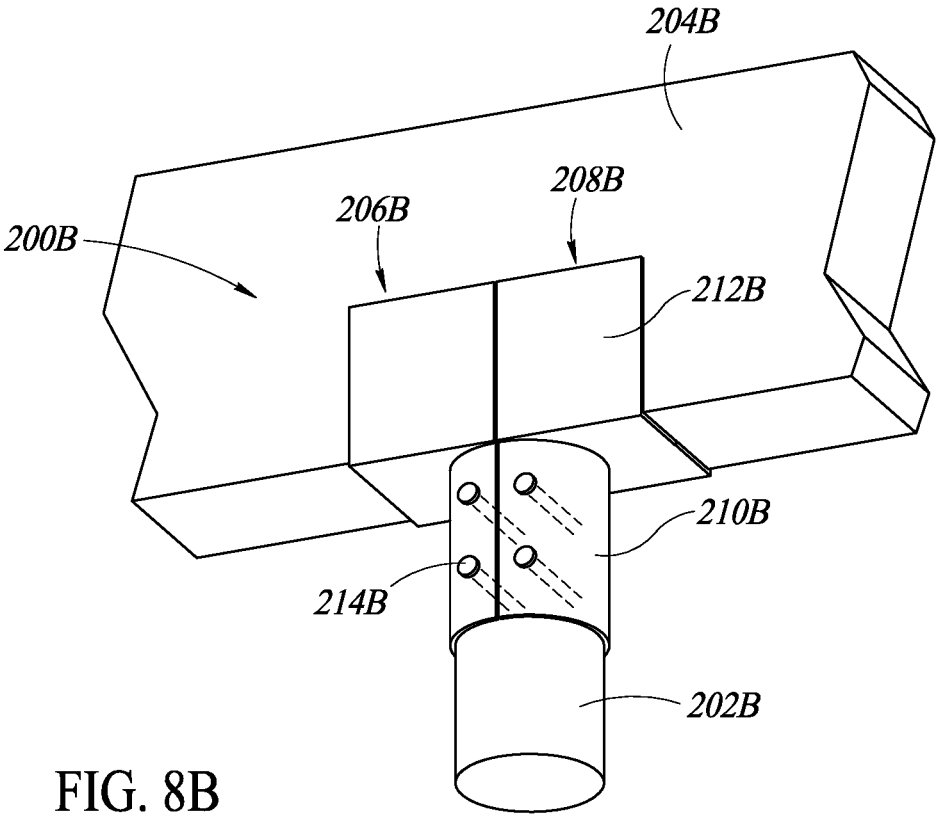
FIG. 8B is a perspective view of a two halves of the bracket coupled around a pile and a pile cap of a structure using bolts that penetrate the bracket base and the pile according to one or more embodiments of the present disclosure.

In FIG. 8B, a bracket 200B is coupled to a pile 202B and a pile cap 204B at the interface between the pile 202B and the pile cap 204B. The bracket 200B includes a first half 206B coupled to a second half 208B with each half 206B, 208B including a base 210B coupled to an upward facing U-shaped flange 212B. The halves 206B, 208B of the bracket 200B are coupled to the pile 202B and pile cap 204B with fasteners 214B. The fasteners 214B may be any fastener presently available or developed in the future, including, without limitation, nails, screws, bolts, and other like devices. Further, the fasteners 214B may be inserted through pre-drilled or preformed holes in the bracket 200B or may be inserted directly through the bracket 200B and into the pile 202B and pile cap 204B. Although the fasteners 214B are illustrated as being only through the base 210B of each half 206B, 208B of the bracket 200B, the fasteners 214B may be selected to be located on any part of the bracket 200B.

Figure 8C:
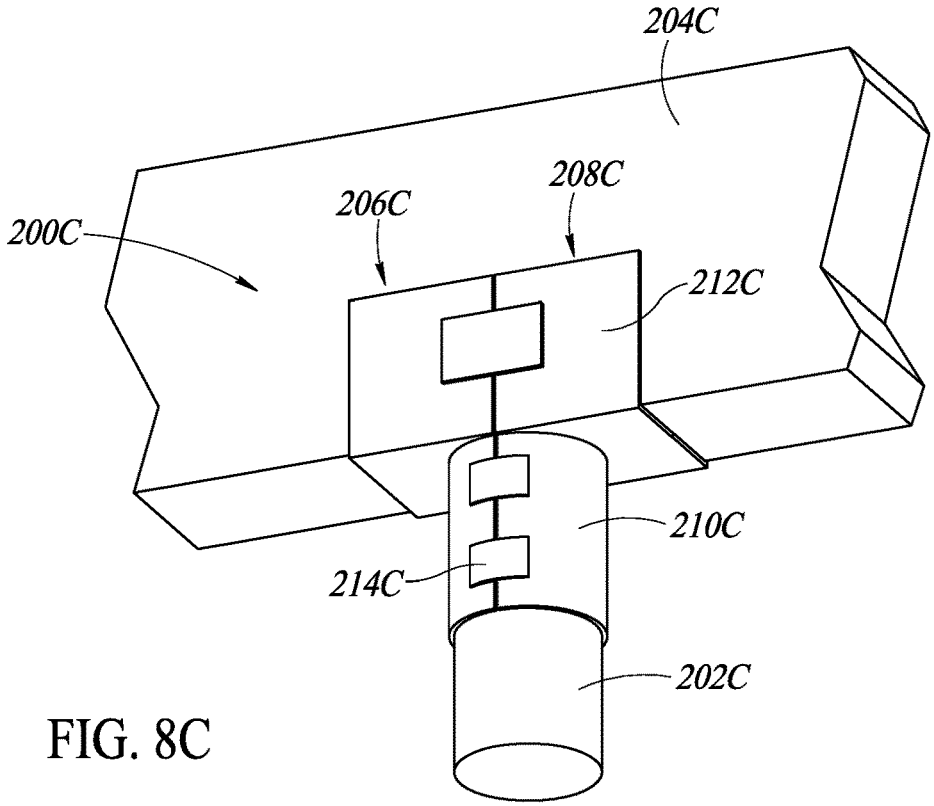
FIG. 8C is a perspective view of a two halves of the bracket coupled to each other via fastening plates around a pile and a pile cap of a structure according to one or more embodiments of the present disclosure.

FIG. 8C is a perspective view of a bracket 200C coupled to a pile 202C and a pile cap 204C at the interface between the pile 202C and the pile cap 204C. The bracket 200C includes a first half 206C coupled to a second half 208C with each half 206C, 208C including a base 210C coupled to an upward facing U-shaped flange 212C. As shown in FIG. 8C, the halves 206C, 208C are coupled to each other with plates or brackets 214C. The plates 214C are in direct contact with each half 206C, 208C of the bracket 200C and may be coupled to the base 210C or the upward facing U-shaped flange 212C, or both, of each half 206C, 208C of the bracket 200C. The size, shape, orientation, and other dimensions of the plates 214C can be selected according to design factors. Further, the plates 214C can be coupled to the halves 206C, 208C of the bracket 200C according to any of the coupling devices, systems, or methods described herein, including with welding, additional brackets or latches, and fasteners in some non-limiting examples.

Figure 8D:
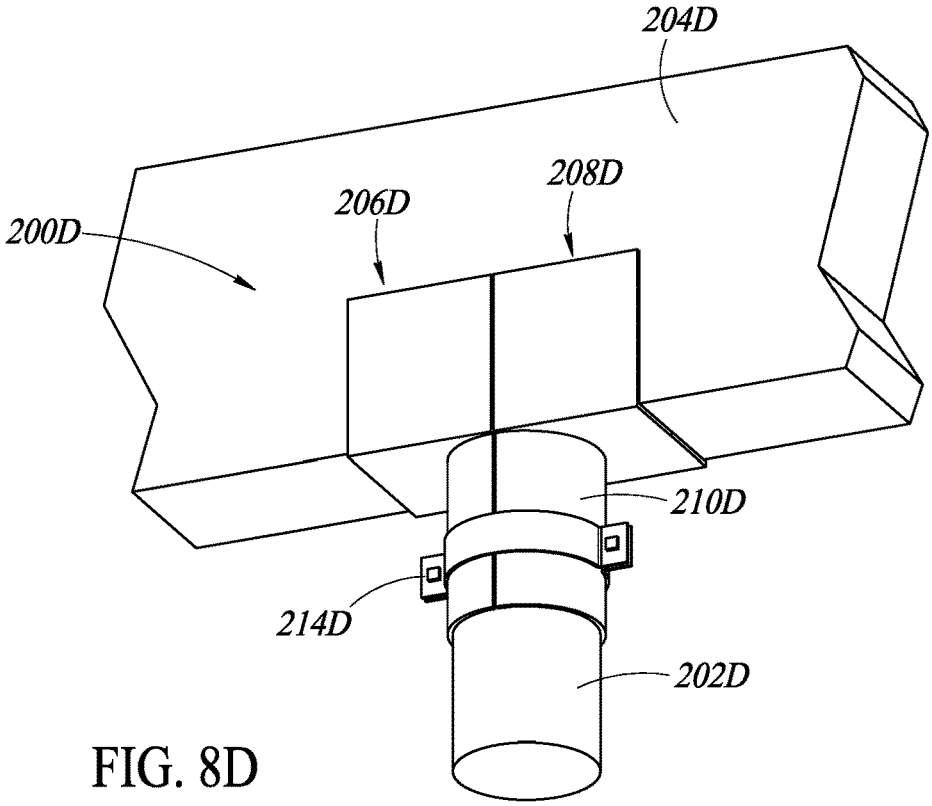
FIG. 8D is a perspective view of a two halves of the bracket coupled to each other via clamps around a pile and a pile cap of a structure according to one or more embodiments of the present disclosure.

In FIG. 8D, a bracket 200D is coupled to a pile 202D and a pile cap 204D at the interface between the pile 202D and the pile cap 204D. The bracket 200D includes a first half 206D coupled to a second half 208D with each half 206D, 208D including a base 210D coupled to an upward facing U-shaped flange 212D. The halves 206D, 208D of the bracket 200D are coupled to each other with a clamp 214D, which may be pole or pipe clamp in some non-limiting examples. Further, although the clamp 214D is illustrated as being coupled to the base 210D of each half 206D, 208D of the bracket 200D, the clamp 214D may also be coupled to the upward facing U-shaped flange 210D.

Figure 8E:
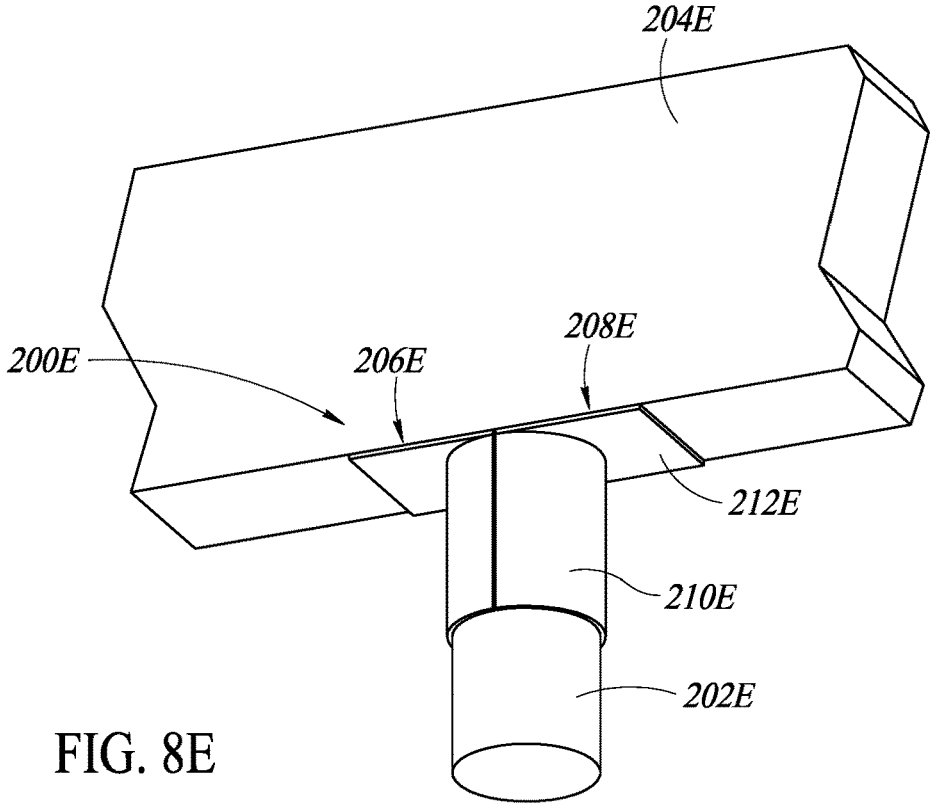
FIG. 8E is a perspective view of a two halves of the bracket coupled to each other around a pile and a pile cap of a structure according to one or more embodiments of the present disclosure.

In FIG. 8E, a bracket 200E is coupled to a pile 202E and a pile cap 204E at the interface between the pile 202E and the pile cap 204E. The bracket 200E includes a first half 206E coupled to a second half 208E with each half 206E, 208E including a base 210E coupled to a support plate 212E. As shown in FIG. 8E, the bracket 200E may not include sidewalls or a flange as in other embodiments, but rather, may include only a support plate 212E underneath the pile cap 204E with the support plate 212E coupled to the pile cap 204E according to any of the bolts, fasteners, coupling devices, systems, and methods described herein. Thus, in some embodiments, the bracket 200E may be coupled to only one side or one surface of the pile cap 204E.

Figure 8F:
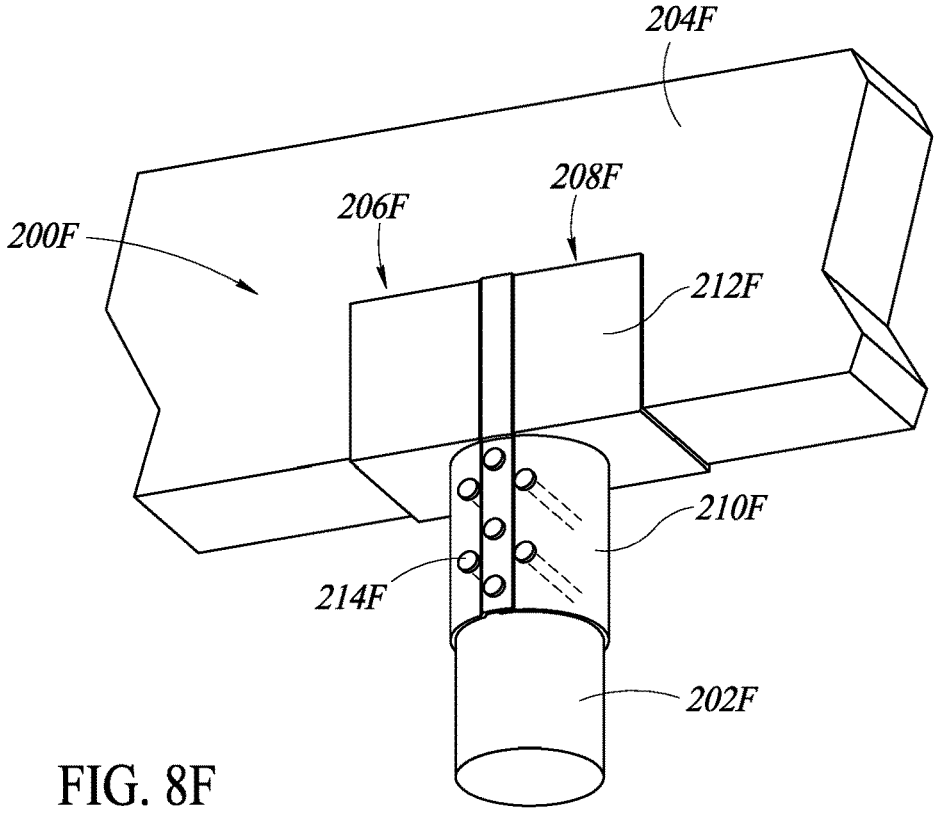
FIG. 8F is a perspective view of a two halves of the bracket coupled to each other around a pile and a pile cap of a structure, in which one half of the bracket overlaps the other half of the bracket, according to one or more embodiments of the present disclosure.

Referring now to FIG. 8F, a similar configuration is shown to that of FIG. 8B except that the edge of the half 206F of the bracket 100, and the lower edge of half of the cylindrical base 210F overlaps the edge of the half 208F of the bracket 100, and the lower edge of half of the cylindrical base 210F (i.e., the edge of the half 208F of the bracket 100 slides under the edge of the half 206F of the bracket 100). In another embodiment (not shown), the edge of the half 208F of the bracket 100, and the lower edge of half of the cylindrical base 210F overlaps the edge of the half 206F of the bracket 100, and the lower edge of half of the cylindrical base 210F (i.e., the edge of the half 206F of the bracket 100 slides under the edge of the half 208F of the bracket 100). In still another embodiment (not shown), the edge of the half 206F of the bracket 100 overlaps the edge of the half 208F of the bracket 100, (i.e., the edge of the half 208F of the bracket 100 slides under the edge of the half 206F of the bracket 100, but edges of the cylindrical base 210F abut one another). In yet another embodiment (not shown), the edge of the half 208F of the bracket 100, overlaps the edge of the half 206F of the bracket 100, (i.e., the edge of the half 206F of the bracket 100 slides under the edge of the half 208F of the bracket 100, but edges of the cylindrical base 210F abut one another).

As further shown in FIG. 8F, bolts or other fasteners may then be secured through the overlapping region of the base. In other embodiments (not shown), bolts or other fasteners are secured through the overlapping region of each half 206F, 208F of the bracket 100, in addition to, or instead of, the bolts or other fasteners being secured through the overlapping region of the cylindrical base (i.e., below each half 206F, 208F of the bracket 100). Additionally or alternatively, in some embodiments the overlapping halves 206F, 208F of the bracket 200F and the base 210F are welded together as well as the connection techniques described above.

A bracket 200F is coupled to a pile 202F and a pile cap 204F at the interface between the pile 202F and the pile cap 204F. The bracket 200F includes a first half 206F coupled to a second half 208F with each half 206F, 208F including a base 210F coupled to an upward facing U-shaped flange 212F. The halves 206F, 208F of the bracket 200F are coupled to the pile 202F and pile cap 204F with fasteners 214F. The fasteners 214F may be any fastener presently available or developed in the future, including, without limitation, nails, screws, bolts, and other like devices. Further, the fasteners 214F may be inserted through pre-drilled or preformed holes in the bracket 200F or may be inserted directly through the bracket 200F and into the pile 202F and pile cap 204F. Although the fasteners 214F are illustrated as being only through the base 210F of each half 206F, 208F of the bracket 200F, the fasteners 214F may be selected to be located on any part of the bracket 200F.

FIGS. 8A-8F illustrate representative and non-limiting examples of coupling devices, systems, and methods for joining two halves of a bracket around a pile and a pile cap of a structure. It is to be appreciated that the coupling devices, systems, and methods described herein can be combined with each other to form yet further embodiments. For example, the connection between halves of a bracket may include any of the devices, systems, and methods described herein and their structural equivalents in further embodiments. Thus, the present disclosure is not limited to using only one type of coupling device, system, or method in joining the two halves of the brackets described herein.

Figure 9:
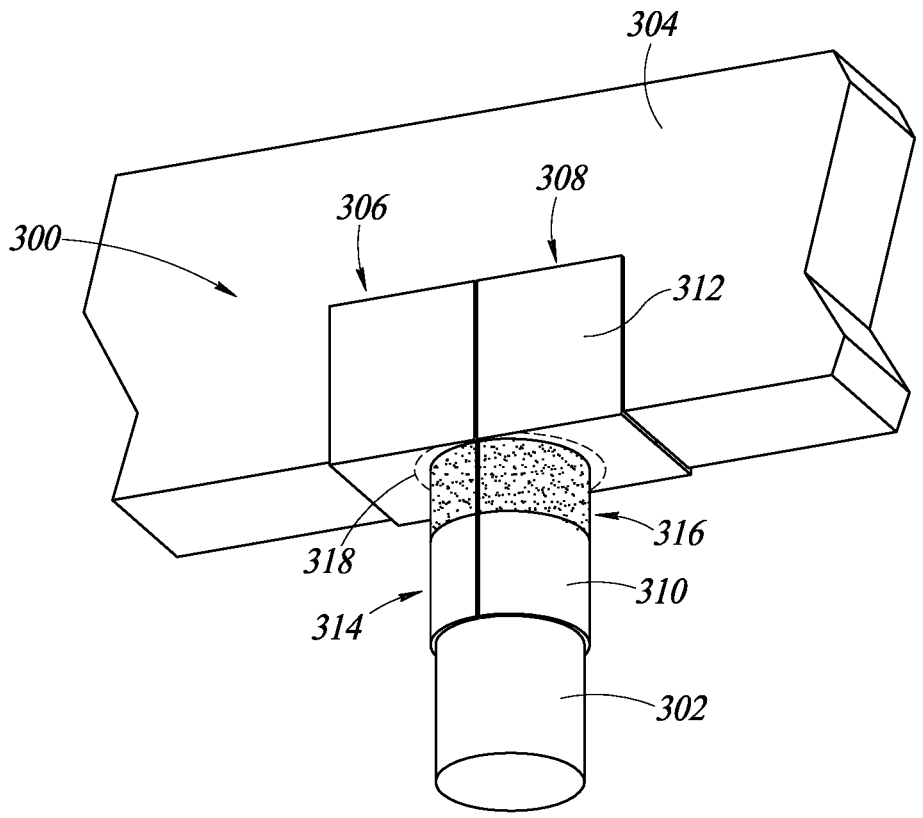
FIG. 9 is a perspective view of a bracket coupled to an interface between a pile and a pile cap of a structure according to an embodiment of the present disclosure.

FIG. 9 is a perspective view of a bracket 300 coupled to a pile 302 and a pile cap 304 of a structure at an interface between the pile 302 and the pile cap 304 according to one or more embodiments of the present disclosure. The bracket 300 may be identical to any of the other brackets described herein, except as otherwise provided below.

The bracket 300 includes a first half 306 coupled to a second half 306 of the bracket 300 with each half 306, 308 including a base 310 coupled to an upward facing U-shaped flange 312. In some embodiments, the base 310 or the upward facing U-shaped flange 312, or both, of each half 306, 308 of the bracket 300 may include sections or portions of material with a different composition or material properties and characteristics than the remainder of the bracket. As shown in FIG. 9, the base 310 of each half 306, 308 of the bracket 300 includes a first section 314 spaced from the interface between the pile 302 and the pile cap 304 and a second section 316 adjacent to the interface between the pile 302 and the pile cap 304. The first section 314 of the base 310 may include a first material with certain properties and characteristics, such as steel or aluminum in some non-limiting examples. The second section 316 of the base 310 may include a second material with different properties and characteristics than the first section 314. In particular, the material of the second section 316 may be selected to be a material with a different modulus of elasticity, tensile strength, or yield strength, among other characteristics, relative to the first section 314.

In some embodiments, the second section 316 has a higher modulus of elasticity than the first section 314 to reduce the strain in the bracket 300 proximate the interface between the pile 302 and the pile 304 under the stresses applied by a seismic event. In some embodiments, it may be advantageous to have the second section 316 have a lower modulus of elasticity than the first section 314. For example, using a material such as rubber or another like elastic material at the second section 316 may allow the second section to act as a spring or shock absorber proximate the interface between the pile 302 and the pile cap 304. Although the second section 316 is illustrated as being only part of the base 310 of each half 306, 308 of the bracket 300, it is to be appreciated that any portion of either or both halves 306, 308 of the bracket 300 can include one or more sections or portions with a material having a different material composition than the remainder of the bracket 300. For example, the second section 316 may extend to a bottom portion of the upward facing U-shaped flange 312 in some embodiments, as indicated by dashed line 318. Still further, the bracket 300 can include a selected number of sections of different materials, such as three, four, or five or more sections positioned at any selected location throughout the bracket 300, in some embodiments.

Figure 10:
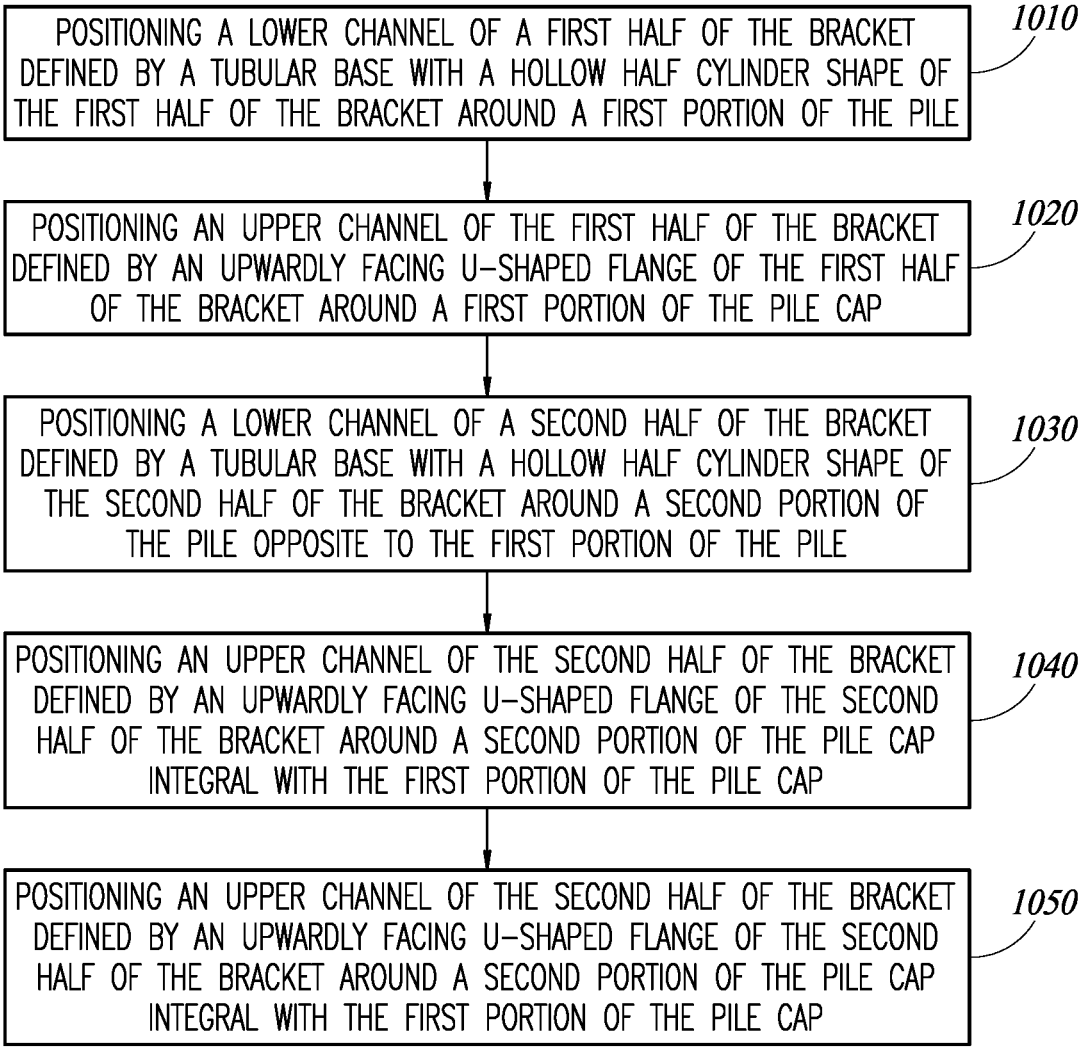
FIG. 10 is a logic diagram showing the coupling of a bracket to a pile and a pile cap of a structure.

FIG. 10 is a logic diagram showing the coupling of a bracket to a pile and a pile cap of a structure. As shown in FIG. 10, at operation 1010, a lower channel of a first half of the bracket defined by a tubular base with a hollow half cylinder shape of the first half of the bracket is positioned around a first portion of the pile. At operation 1020, an upper channel of the first half of the bracket defined by an upwardly facing U-shaped flange of the first half of the bracket is positioned around a first portion of the pile cap. At operation 1030, a lower channel of a second half of the bracket defined by a tubular base with a hollow half cylinder shape of the second half of the bracket is positioned around a second portion of the pile opposite to the first portion of the pile. At operation 1040, an upper channel of the second half of the bracket defined by an upwardly facing U-shaped flange of the second half of the bracket is positioned around a second portion of the pile cap integral with the first portion of the pile cap. At operation 1050, the first half of the bracket to the second half of the bracket is coupled around a portion of a circumference of the pile and around a portion of a longitudinal section of the pile cap.

In view of the above, the brackets of the present disclosure have reduced manufacturing and installation costs relative to known seismic remediation devices. Further, the brackets can be installed without disassembling any portion of a structure and thus reduce potential downtime and loss of use of the structure during installation of remediation devices. The brackets of the present disclosure also considerably improve the structure's response to a seismic event by strengthening the connection between the pile and the pile cap of a pile supported structure. This improved response reduces damage to the structure as a result of a seismic event, which can further reduce repair costs and downtime, while also allowing the structure to continue supporting most, if not all, of its intended load after a seismic event and allowing people and objects in the vicinity of the structure to be moved to safety after a seismic event. Thus, the concepts of the present disclosure provide these and other benefits and advantages over known seismic remediation devices.

From the foregoing it will be appreciated that, although specific embodiments have been described herein for purposes of illustration, various modifications may be made without deviating from the spirit and scope of the invention. Accordingly, the technology is not limited except by the corresponding claims and the elements recited by those claims. In addition, while certain aspects of the technology may be presented in certain claim forms at certain times, the inventors contemplate the various aspects of the invention in any available claim form.

The above description of illustrated embodiments, including what is described in the Abstract, is not intended to be exhaustive or to limit the implementations to the precise forms disclosed. Although specific embodiments and examples are described herein for illustrative purposes, various equivalent modifications can be made without departing from the spirit and scope of the disclosure, as will be recognized by those skilled in the relevant art. The teachings provided herein of the various embodiments can be applied outside of the sanitation device, system, and method context, and are not limited to the examples generally described above.

Many of the methods described herein can be performed with variations. For example, many of the methods may include additional acts, omit some acts, and/or perform acts in a different order than as illustrated or described.

Certain words and phrases used in the specification are set forth as follows. As used throughout this document, including the claims, the singular form "a", "an", and "the" include plural references unless indicated otherwise. Any of the features and elements described herein may be singular, e.g., a sensor may refer to one sensor and a memory may refer to one memory. The terms "include" and "comprise," as well as derivatives thereof, mean inclusion without limitation. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Other definitions of certain words and phrases are provided throughout this disclosure.

The use of ordinals such as first, second, third, etc., does not necessarily imply a ranked sense of order, but rather may only distinguish between multiple instances of an act or a similar structure or material.

Throughout the specification, claims, and drawings, the following terms take the meaning explicitly associated herein, unless the context clearly dictates otherwise. The term "herein" refers to the specification, claims, and drawings associated with the current application. The phrases "in one embodiment," "in another embodiment," "in various embodiments," "in some embodiments," "in other embodiments," and other variations thereof refer to one or more features, structures, functions, limitations, or characteristics of the present disclosure, and are not limited to the same or different embodiments unless the context clearly dictates otherwise. As used herein, the term "or" is an inclusive "or" operator, and is equivalent to the phrases "A or B, or both" or "A or B or C, or any combination thereof," and lists with additional elements are similarly treated. The term "based on" is not exclusive and allows for being based on additional features, functions, aspects, or limitations not described, unless the context clearly dictates otherwise. In addition, throughout the specification, the meaning of "a," "an," and "the" include singular and plural references.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the present disclosure.

The terms "top," "bottom," "upper," "lower," "left," "right," and other like derivatives are used only for discussion purposes based on the orientation of the components in the Figures of the present disclosure. These terms are not limiting with respect to the possible orientations explicitly disclosed, implicitly disclosed, or inherently disclosed in the present disclosure and unless the context clearly dictates otherwise, any of the aspects of the embodiments of the disclosure can be arranged in any orientation.

Generally, unless otherwise indicated, the materials for making the invention and/or its components may be selected from appropriate materials such as metal, metallic alloys (high strength alloys, high hardness alloys), composite materials, ceramics, intermetallic compounds, and the like.

The foregoing description, for purposes of explanation, uses specific nomenclature and formula to provide a thorough understanding of the disclosed embodiments. It should be apparent to those of skill in the art that the specific details are not required in order to practice the invention. The embodiments have been chosen and described to best explain the principles of the disclosed embodiments and its practical application, thereby enabling others of skill in the art to utilize the disclosed embodiments, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

Unless the context clearly dictates otherwise, relative terms such as "approximately," "substantially," "generally," and other derivatives include an ordinary error range or manufacturing tolerance due to slight differences and variations in manufacturing, and when used to describe a value, amount, quantity, or dimension, generally refer to a value, amount, quantity, or dimension that is within plus or minus 5% of the stated value, amount, quantity, or dimension. It is to be further understood that any specific dimensions of components or features provided herein are for illustrative purposes only with reference to the various embodiments described herein, and as such, it is expressly contemplated in the present disclosure to include dimensions that are more or less than the dimensions stated, unless the context clearly dictates otherwise.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the breadth and scope of a disclosed embodiment should not be limited by any of the above-described embodiments, but should be defined only in accordance with the following claims and their equivalents.

The invention claimed is:

1. A pile support bracket to mitigate structural failure of a pile, comprising:

a vertical cylindrical concrete pile at least partially submerged under water;

a rectangular horizontal concrete pile cap positioned on top of the vertical cylindrical concrete pile;

a body including a first half and a second half structured to be coupled to the first half, the first half of the body including:

a tubular base having a hollow half cylinder shape shaped and sized to match a first half of the vertical cylindrical concrete pile;

a lower channel defined by the tubular base;

an upwardly facing U-shaped flange coupled to the tubular base, the upwardly facing U-shaped flange configured to receive a lower surface of the rectangular horizontal concrete pile cap; and an upper channel defined by the flange;

the second half of the body including:

a tubular base having a hollow half cylinder shape that is shaped and sized to match a second half of the vertical cylindrical concrete pile;

a lower channel defined by the tubular base;

an upwardly facing U-shaped flange coupled to the tubular base, the upwardly facing U-shaped flange configured to receive the lower surface of the rectangular horizontal concrete pile cap; and an upper channel defined by the flange, wherein the lower channel of the first half of the body and the lower channel of the second half of the body are securable around a circumference of the vertical cylindrical concrete pile and the upper channel of the first half of the body and the upper channel of the second half of the body are securable around a longitudinal section of rectangular horizontal concrete pile cap.

2. The bracket of claim 1 wherein the lower channel of the first half of the body is perpendicular to the upper channel of the first half of the body.

3. The bracket of claim 1 wherein the lower channel of the first half of the body has a same size and shape as the lower channel of the second half of the body.

4. The bracket of claim 1 wherein the upper channel of the first half of the body has a same size and shape as the upper channel of the second half of the body.

5. The bracket of claim 1 wherein the upwardly facing U-shaped flange of the first half of the body includes sidewalls that define the upper channel of the first half of the body, the sidewalls of the upwardly facing U-shaped flange of the first half of the body being flat and planar.

6. The bracket of claim 1 wherein the upwardly facing U-shaped flange of the second half of the body includes sidewalls that define the upper channel of the second half of the body, the sidewalls of the flange of the second half of the body being flat and planar.

7. The bracket of claim 1 wherein the first half of the body includes tabs and the second half of the body includes tabs corresponding to the tabs of the first half of the body, the first half of the body being coupleable to the second half of the body with nut and bolt assemblies through the tabs of the first half of the body and the tabs of the second half of the body.

8. The bracket of claim 1 wherein the first half of the body is coupled to the second half of the body with at least one of a welded connection, a bracket, and a latch.

9. The bracket of claim 1 wherein the tubular base of the first half of the body and the tubular base of the second half of the body each include a first material having a modulus of elasticity and a second material having a modulus of elasticity greater than the modulus of elasticity of the first material, the second material positioned proximate an interface between the pile and the pile cap to reduce strain at the interface.

10. A pile support device, comprising:

a vertical cylindrical pile structure that is driven into a ground surface;

a horizontal pile cap positioned perpendicular to and on top of the vertical cylindrical pile structure;

a bracket structured to be coupled to the vertical cylindrical pile structure and the horizontal pile cap, the bracket including:

a first half including a lower channel and an upper channel, the upper channel of the first half of the bracket defined by the upwardly facing U-shaped flange that is configured to receive the horizontal pile cap, the lower channel of the first half of the bracket having a hollow half cylinder configuration that is shaped and sized to match a first half of the vertical cylindrical pile structure;

a second half including a lower channel and an upper channel, the upper channel of the second half of the bracket defined by the upwardly facing U-shaped flange that is configured to receive the horizontal pile cap, the lower channel of the second half of the bracket having a hollow half cylinder configuration that is shaped and sized to match a second half of the vertical cylindrical pile structure;

the second half structured to be coupled to the first half with the lower channel of the first half and the lower channel of the second half cooperating to define a pile channel securable around at least a portion of a circumference of the vertical cylindrical pile structure and the upper channel of the first half and the upper channel of the second half cooperating to define a pile cap channel securable around at least a longitudinal portion of the horizontal pile cap.

11. The device of claim 10 wherein the lower channel of the first half and the lower channel of the second half each have a different shape than the upper channel of the first half and the second upper of the second half.

12. The device of claim 10 wherein the lower channel of the first half is perpendicular to the upper channel of the second half.

13. The device of claim 10 wherein the first half of the bracket includes a base and an upwardly facing U-shaped flange coupled to the base, the lower channel of the first half of the bracket defined by the base, the base of the first half of the bracket having a hollow half cylinder shape and the upwardly facing U-shaped flange of the first half of the bracket having a rectangular shape with flat and planar sidewalls.

14. The device of claim 10 wherein the second half of the bracket includes a base and an upwardly facing U-shaped flange coupled to the base, the lower channel of the second half of the bracket defined by the base, the base of the second half of the bracket having a hollow half cylinder shape and the upwardly facing U-shaped of the second half of the bracket having a rectangular shape with flat and planar sidewalls.

15. The device of claim 10 wherein each of the lower channels of the first half of the bracket and the second half of the bracket have a same size and shape and each of the upper channels of the first half of the bracket and the second half of the bracket have a same size and shape.

16. A method for supporting a concrete pile cap, comprising:

providing a vertical cylindrical concrete pile at least partially submerged under water;

providing rectangular horizontal concrete pile cap positioned on top of the vertical cylindrical concrete pile;

selecting a size, shape, and radius of curvature of a pile support bracket having a first half and a second half, the first half and second half each having an upper channel that is sized and shaped based on the rectangular horizontal concrete pile cap, and the first half and second half each having a lower channel that is sized and shaped based on the radius, diameter, size vertical cylindrical concrete pile, coupling the bracket to the vertical cylindrical concrete pile and the rectangular horizontal concrete pile cap of a structure, including:

positioning a lower channel of a first half of the bracket defined by a tubular base with a hollow half cylinder shape of the first half of the bracket around a first portion of the vertical cylindrical concrete pile;

positioning an upper channel of the first half of the bracket defined by an upwardly facing U-shaped flange of the first half of the bracket around a first portion of the rectangular horizontal concrete pile cap;

positioning a lower channel of a second half of the bracket defined by a tubular base with a hollow half cylinder shape of the second half of the bracket around a second portion of the pile opposite to the first portion of the vertical cylindrical concrete pile;

positioning an upper channel of the second half of the bracket defined by an upwardly facing U-shaped flange of the second half of the bracket around a second portion of the rectangular horizontal concrete pile cap, which is integral with the first portion of the pile cap; and coupling the first half of the bracket to the second half of the bracket around a portion of a circumference of the vertical cylindrical concrete pile and around a portion of a longitudinal section of the rectangular horizontal concrete pile cap.

17. The method of claim 16 wherein the coupling the first half of the bracket to the second half of the bracket includes at least one of coupling at least one nut and bolt assembly to a corresponding at least one tab coupled to the first half of the bracket and at least one tab coupled to the second half of the bracket, welding, coupling a plate to both the first half of the bracket and the second half of the bracket, securing a latch between the first half of the bracket and the second half of the bracket, securing a clamp between the first half of the bracket and the second half of the bracket, and fastening the first half of the bracket and the second half of the bracket to the pile with fasteners.

18. The method of claim 16 wherein the coupling the first half of the bracket to the second half of the bracket includes aligning the lower channel of the first half of the bracket with the lower channel of the second half of the bracket to define a pile channel securable around the portion of the circumference of the vertical cylindrical concrete pile and aligning the upper channel of the first half of the bracket with the upper channel of the second half of the bracket to define a pile cap channel securable around the portion of the longitudinal section of the rectangular horizontal concrete pile cap.

19. The method of claim 16 wherein the positioning the upper channel of the first half of the bracket includes arranging the upper channel of the first half of the bracket perpendicular to the lower channel of the first half of the bracket.

20. The method of claim 16 wherein the coupling the bracket to the vertical cylindrical concrete pile and the rectangular horizontal concrete pile cap includes coupling the bracket to an interface between the vertical cylindrical concrete pile and the rectangular horizontal concrete pile cap.

* * * * *